US007257339B2

(12) United States Patent
Yokoyama et al.

(10) Patent No.: US 7,257,339 B2
(45) Date of Patent: Aug. 14, 2007

(54) METHOD AND APPARATUS FOR IMAGE FORMING CAPABLE OF EFFECTIVELY REDUCING UNEVENNESS OF DENSITY AND COLOR DISPLACEMENT OF IMAGES

(75) Inventors: Masato Yokoyama, Yokohama (JP); Nobuto Yokokawa, Kawaguchi (JP); Toshiyuki Ando, Sagamihara (JP); Kazuhiko Kobayashi, Ota-ku (JP); Tadashi Shinohara, Yokohama (JP); Yuuji Matsuda, Inagi (JP); Jun Hosokawa, Shinagawa-ku (JP); Yohhei Miura, Kawasaki (JP); Toshiyuki Takahashi, Kawasaki (JP); Hiromichi Matsuda, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 157 days.

(21) Appl. No.: 10/893,391

(22) Filed: Jul. 19, 2004

(65) Prior Publication Data

US 2005/0053388 A1 Mar. 10, 2005

(30) Foreign Application Priority Data

Jul. 18, 2003 (JP) ..... 2003-199451
Aug. 8, 2003 (JP) ..... 2003-290282
Apr. 30, 2004 (JP) ..... 2004-136026

(51) Int. Cl.
*G03G 15/16* (2006.01)

(52) U.S. Cl. ..... 399/66; 399/302; 399/303

(58) Field of Classification Search ..... 399/66, 399/299, 301, 302, 303, 308, 396, 312, 313
See application file for complete search history.

(56) References Cited

U.S. PATENT DOCUMENTS 4,914,477 A * 4/1990 Young et al. ..... 399/301
5,130,583 A 7/1992 Andoh (Continued)

FOREIGN PATENT DOCUMENTS

JP 63-147177 6/1988
JP 01031173 A * 2/1989

(Continued)

OTHER PUBLICATIONS

U.S. Appl. No. 11/420,929, filed May 30, 2006, Matsuda.

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus including an image carrying member, a transfer member, support rollers, a detecting mechanism, and a controller. The image carrying member forms a toner image on its surface facing a surface of the transfer member, supported by the support rollers, which transfers the toner image to a recording medium. The detecting mechanism includes a detection roller, a roller shaft, a moving member, and a sensor, and detects a speed of the transfer member. The detection roller includes one support roller selected from the support rollers, and is provided with the roller shaft. The moving member is directly fixed to the roller shaft and rotates with the detection roller. The sensor detects a moving speed of the detection roller with the moving member. The controller controls a traveling speed of the transfer member to a target speed based on a detection result of the sensor.

25 Claims, 21 Drawing Sheets

U.S. PATENT DOCUMENTS 5,164,783 A * 11/1992 Taguchi et al. ..... 399/301
5,265,188 A 11/1993 Andoh
5,289,088 A 2/1994 Andoh
5,321,483 A 6/1994 Yokoyama et al.
5,404,206 A 4/1995 Andoh et al.
5,598,254 A 1/1997 Ikesue et al.
5,606,408 A 2/1997 Yano et al.
5,619,316 A 4/1997 Shoji et al.
5,621,221 A 4/1997 Shinohara et al.
5,638,159 A 6/1997 Kai et al.
5,719,684 A 2/1998 Ohkaji et al.
5,737,665 A 4/1998 Sugiyama et al.
5,765,083 A 6/1998 Shinohara
5,774,772 A 6/1998 Kai et al.
5,799,229 A 8/1998 Yokoyama et al.
5,875,380 A 2/1999 Iwata et al.
5,878,317 A 3/1999 Masuda et al.
5,899,597 A 5/1999 Shinohara et al.
5,915,155 A 6/1999 Shoji et al.
5,946,529 A 8/1999 Sato et al.
5,950,059 A * 9/1999 Sahara ..... 399/303
5,962,783 A 10/1999 Iwata et al.
5,963,240 A 10/1999 Shinohara et al.
5,999,773 A 12/1999 Yasutomi et al.
6,031,633 A 2/2000 Andoh et al.
6,038,410 A * 3/2000 Iriyama ..... 399/51
6,118,557 A 9/2000 Sugiyama et al.
6,125,243 A 9/2000 Shoji et al.
6,128,459 A 10/2000 Iwata et al.
6,167,221 A 12/2000 Kobayashi
6,282,396 B1 8/2001 Iwata et al.
6,295,435 B1 9/2001 Shinohara et al.
6,295,438 B1 9/2001 Fujishiro et al.
6,298,586 B1 * 10/2001 Todome ..... 399/303
6,321,052 B1 * 11/2001 Yamashina et al. ..... 399/165
6,380,960 B1 4/2002 Shinohara
6,381,435 B2 4/2002 Shinohara et al.
6,416,176 B1 7/2002 Yasui et al.
6,573,918 B2 6/2003 Kobayashi et al.
6,587,137 B2 7/2003 Shinohara et al.
6,593,951 B2 7/2003 Yokoyama et al.
6,669,189 B2 12/2003 Seto et al.
6,690,896 B2 2/2004 Hanada et al.
6,693,654 B2 2/2004 Shinohara
6,704,035 B2 3/2004 Kobayashi et al.
6,708,017 B2 3/2004 Yamanaka et al.
6,711,364 B2 3/2004 Shinohara
6,714,224 B2 3/2004 Yamanaka et al.
6,719,469 B2 4/2004 Yasui et al.
6,741,825 B2 * 5/2004 Omata et al. ..... 399/309
6,925,279 B2 * 8/2005 Kamoshita et al. ..... 399/303
2002/0012549 A1 1/2002 Oku
2002/0136570 A1 9/2002 Yamanaka et al.
2003/0002887 A1 * 1/2003 Imaizumi et al. ..... 399/167
2003/0137577 A1 7/2003 Shinohara et al.
2003/0223784 A1 12/2003 Yamanaka et al.
2004/0009019 A1 1/2004 Hosokawa
2004/0033090 A1 2/2004 Yamanaka et al.
2004/0041896 A1 3/2004 Shinohara
2004/0041992 A1 3/2004 Yokoyama
2004/0086299 A1 5/2004 Matsuda et al.
2004/0104993 A1 6/2004 Yokoyama
2004/0109708 A1 6/2004 Kobayashi et al.
2004/0114972 A1 6/2004 Yamanaka et al.
2004/0119805 A1 6/2004 Yamanaka et al.
2004/0126129 A1 7/2004 Kobayashi
2004/0164691 A1 8/2004 Andoh et al.
2005/0053388 A1 3/2005 Yokoyama et al.

FOREIGN PATENT DOCUMENTS

JP 9-160324 6/1997
JP 11-202576 7/1999
JP 11201263 A * 7/1999
JP 11202576 A * 7/1999
JP 2000-47547 2/2000
JP 2001-112276 4/2001
JP 2001-141736 5/2001
JP 2001-296755 10/2001
JP 2002-132008 5/2002
JP 2003-65799 3/2003
JP 2003-173091 6/2003

OTHER PUBLICATIONS

U.S. Appl. No. 11/246,379, filed Oct. 11, 2005, Matsuda et al.
U.S. Appl. No. 11/203,309, filed Aug. 15, 2005, Matsuda et al.
U.S. Appl. No. 11/141,639, filed Jun. 1, 2005, Matsuda et al.
U.S. Appl. No. 09/374,133, filed Aug. 10, 1999, Unknown.
U.S. Appl. No. 09/330,669, filed Jun. 11, 1999, Unknown.
U.S. Appl. No. 09/042,613, filed Mar. 17, 1998, Unknown.
U.S. Appl. No. 10/456,469, filed Jun. 9, 2003, Kamiya et al.
U.S. Appl. No. 10/724,998, filed Dec. 2, 2003, Kudo et al.
U.S. Appl. No. 10/784,933, filed Feb. 25, 2004, Yoshizawa et al.
U.S. Appl. No. 10/893,391, filed Jul. 19, 2004, Yokoyama et al.
U.S. Appl. No. 11/608,008, filed Dec. 7, 2006, Katoh et al.
U.S. Appl. No. 11/558,645, filed Nov. 10, 2006, Takahashi et al.

* cited by examiner

FIG. 22A

| | 1.5 mm ROLLER (REFERENCE) | 2.0 mm ROLLER | 2.5 mm ROLLER | 3.0 mm ROLLER |
|---|---|---|---|---|
| THICKNESS (mm) | 1.5 | 2 | 2.5 | 3 |
| BASE AREA (mm^2) | 65.9734 | 84.8230 | 102.1018 | 117.8097 |
| VOLUME (mm^3) | 20121.9009 | 25871.0155 | 31141.0372 | 35931.9660 |
| MATERIAL | Al | Al | Al | Al |
| DENSITY (kg/m^3) | 2770 | 2770 | 2770 | 2770 |
| SPECIFIC HEAT (J/kg·℃) | 875 | 875 | 875 | 875 |
| LINEAR EXPANSION COEFFICIENT (1/℃) | 0.000023 | 0.000023 | 0.000023 | 0.000023 |
| MASS OF ROLLER (g) | 55.73766562 | 71.66271294 | 86.26067299 | 99.53154575 |
| WORK REQUIRED TO RAISE THE TEMPERATURE BY ONE CELSIUS DEGREE (J) | 48.77045742 | 62.70487382 | 75.47808886 | 87.09010253 |
| | | | | |
| LINEAR EXPANSION COEFFICIENT AGAINST A REFERENCE ROLLER | 0.000023 | 0.000018 | 0.000014862 | 0.000012880 |
| DIAMETER EXPANSION COEFFICIENT AGAINST A REFERENCE ROLLER | 1.000 | 0.778 | 0.646 | 0.560 |
| MOMENT OF INERTIA (kgf·cm^2) | 12.3 | 13.3 | 15.7 | 16.4 |

FIG. 22B

| | NON-COATED ROLLER | 0.8 mm ROLLER | 1.5 mm ROLLER | 0.8 mm ROLLER |
|---|---|---|---|---|
| THICKNESS (mm) | 7.75 | 0.8 | 1.5 | 0.8 |
| BASE AREA (mm^2) | 188.6919 | 36.9451 | 65.9734 | 36.9451 |
| VOLUME (mm^3) | 57551.0322 | 11268.2645 | 20121.9009 | 11268.2645 |
| MATERIAL | Al | Fe | Fe | INVAR |
| DENSITY (kg/m^3) | 2770 | 7850 | 7850 | 8000 |
| SPECIFIC HEAT (J/kg·°C) | 875 | 434 | 434 | 450 |
| LINEAR EXPANSION COEFFICIENT (1/°C) | 0.000023 | 0.000012 | 0.000012 | 0.000001 |
| MASS OF ROLLER (g) | 159.4163591 | 88.45587656 | 157.9569224 | 90.14611624 |
| WORK REQUIRED TO RAISE THE TEMPERATURE BY ONE CELSIUS DEGREE (J) | 139.4893142 | 38.38985043 | 68.55330433 | 40.56575231 |
| | | | | |
| LINEAR EXPANSION COEFFICIENT AGAINST A REFERENCE ROLLER | 0.000008 | 0.000015 | 0.000009 | 0.000001 |
| DIAMETER EXPANSION COEFFICIENT AGAINST A REFERENCE ROLLER | 0.350 | 0.663 | 0.371 | 0.052 |
| MOMENT OF INERTIA (kgf·cm^2) | 19.1 | 19.2 | 31.3 | 19.5 |

METHOD AND APPARATUS FOR IMAGE FORMING CAPABLE OF EFFECTIVELY REDUCING UNEVENNESS OF DENSITY AND COLOR DISPLACEMENT OF IMAGES

BACKGROUND OF THE INVENTION

Field of the Invention

The present invention relates to a method and apparatus for image forming, and more particularly to a method and apparatus for image forming capable of effectively reducing unevenness of density and color displacement of images by controlling a speed of a transfer member with a high precision.

DISCUSSION OF THE BACKGROUND

Conventionally, image forming apparatuses are widely used and known for electro-photo graphic copiers, printers, and facsimiles, or for composite machines having at least one functional combination among electro-photo graphic copier, printer, and facsimile.

For example, an image forming apparatus using a direct transfer method or an intermediate transfer method are widely known.

In the direct transfer method, toner images of each color formed on a plurality of image carrying members are overlayingly transferred to a recording sheet carried and transported on a sheet transport belt. The sheet transport belt is extended to a plurality of support rollers, and at least one of the support rollers is used as a drive roller. The sheet transport belt is driven by the drive motor.

In the intermediate transfer method, toner images of each color formed on a plurality of image carrying members are overlayingly transferred to an intermediate transfer belt, and are transferred to a recording sheet. The intermediate transfer belt is extended to a plurality of support rollers, and at least one of the support rollers is used as a drive roller. The intermediate transfer belt is driven by the drive motor.

A typical image forming apparatus using these methods is provided with a plurality of image carrying members arranged in series, which is referred to as an image forming apparatus of tandem type.

In such an image forming apparatus, it is important not to cause an unevenness of density in a toner image transferred from an image carrying member to a recording sheet or a to an intermediate transfer belt to improve an image quality of a finished image transferred to the recording sheet. To prevent the unevenness of density in the toner image, the image forming apparatus includes a detection roller, a moving member, and a sensor.

At least one of a plurality of support rollers for a sheet transport belt or an intermediate transfer belt is used as the detection roller. The moving member is provided to the detection roller, and rotates with the detection roller. A moving speed of the moving member is detected by the sensor.

Based on a detection result, the drive motor is controlled to make a traveling speed of the sheet transport belt or the intermediate transfer belt to a target speed in a conventional apparatus.

With such a configuration, the traveling speed of the sheet transport belt or the intermediate transfer belt is stabilized not to cause the unevenness of density in the toner image transferred to the recording sheet carried and transported on the sheet transport belt, or not to cause the unevenness of density in the toner image transferred to the intermediate transfer belt from the image carrying member.

Conventionally, a moving speed of the moving member is detected by the sensor with a following configuration.

The detection roller has a roller shaft coupled to a support shaft through a coupling, and the moving member is fixed to the support shaft.

The rotation of the detection roller is transmitted to the support shaft through the roller shaft and the coupling to rotate the moving member, and the moving speed of the moving member is detected by the sensor.

In this case, when the support shaft has an eccentricity against the roller shaft, such an eccentricity causes a cyclical variation in speed of the moving member per rotation, and such a variation in speed of the moving member is detected by the sensor along with other variations in speed. Then, a drive motor is controlled to eliminate all of the variations in speed.

However, the variation in speed of the moving member caused by an eccentricity of the support shaft against the roller shaft is not caused by the variation of the traveling speed of the sheet transport belt or the intermediate transfer belt.

Therefore, if the variation in speed of the moving member caused by an eccentricity of the support shaft is eliminated by a control of the drive motor, the variation in speed of the transfer belt inadvertently occurs, thus the unevenness of density occurs in the toner image transferred to the recording sheet from the image carrying member or from the intermediate transfer belt.

Conventionally, a detecting mechanism is configured as illustrated in FIG. 1.

The detecting mechanism includes a detection roller 10, a roller shaft 42, a slit disk 43, a photo sensor 44, a control device 45, a coupling 60, a support shaft 61, and a drive motor 13.

The detection roller 10 is supported by the roller shaft 42. The roller shaft 42 is coupled to the support shaft 61 through the coupling 60. The slit disk 43 as a moving member is fixed to the support shaft 61. The roller shaft 42 rotates with the detection roller 10. The rotation of the roller shaft 42 is transmitted to the support shaft 61 through the coupling 60 to rotate the slit disk 43. The moving speed of the slit disk 43 is detected by the photo sensor 44, and the drive motor 13 is controlled based on the detection results.

However, the above-described detecting mechanism has drawbacks as follows.

As for the detecting mechanism of FIG. 1, the detection roller 10 is concentrically coupled to the roller shaft 42, and the support shaft 61 is also concentrically coupled to the roller shaft 42. Furthermore, the slit disk 43 is concentrically coupled to the support shaft 61.

However, it is difficult to couple all of these components concentrically with each other.

As for the detecting mechanism of FIG. 1, the detection roller 10 has a slight eccentricity $\delta 1$ against a central axis line X1 of the roller shaft 42.

The slit disk 43 also has a slight eccentricity $\delta 2$ against a central axis line X2 of the support shaft 61.

Furthermore, the central axis line X2 of the support shaft 61 has inevitably a slight eccentricity $\delta 3$ against the central axis line X1 of the roller shaft 42.

Such eccentricities cause variations in a speed for each rotation of the slit disk 43. The variation in a speed of the slit disk 43 is detected by the photo sensor 44, and the drive motor 13 is controlled to eliminate the variation in a speed.

However, when the detection roller 10 is a driven roller, and the drive motor 13 is controlled to eliminate the variation in speed caused by the above-described eccentricities, a variation in traveling speed inadvertently occurs to the sheet transport belt or the intermediate transfer belt.

If such variations in traveling speed of the sheet transport belt or the intermediate transfer belt are not corrected, a color displacement occurs in a synthesized toner image transferred to the recording sheet from the image carrying members or the intermediate transfer belt.

The variation in speed of the slit disk 43 caused by the eccentricities of the detection roller 10, the slit disk 43, and the support shaft 61 is erroneously detected as the variations in traveling speed of the sheet transport belt or the intermediate transfer belt, although the variations in traveling speed of the sheet transport belt or the intermediate transfer belt do not actually occur. When the traveling speed of the sheet transport belt or the intermediate transfer belt is controlled based on such erroneous detection, a color displacement occurs on a finished color image.

Similarly, when the detection roller is a drive roller, the variation in speed of the slit disk 43 caused by the eccentricities of the slit disk 43, and the support shaft 61 is erroneously detected as the variations in traveling speed of the sheet transport belt or the intermediate transfer belt. When the traveling speeds of the sheet transport belt or the intermediate transfer belt are controlled based on such erroneous detection, a color displacement occurs on a finished color image.

The above-described configuration is not intended to eliminate the variation in speed of the slit disk 43 caused by the above-mentioned eccentricities.

Therefore, the above-described configuration cannot prevent the unevenness of density of each toner image transferred to the recording sheet from each of the image carrying members or the intermediate transfer belt. Such unevenness of density becomes more significant when the above-mentioned eccentricities are accumulated.

When the support shaft 61 is coupled to the roller shaft 42 through the coupling 60, and the slit disk 43 is fixed to the support shaft 61 as illustrated in FIG. 1, the eccentricity δ3 of the support shaft 61 against the roller shaft 42 is accumulated to other eccentricities δ1 and δ2, thus the total eccentricity becomes larger. Consequently, the unevenness of density is likely to occur in the toner image transferred to the recording sheet from the image carrying members or the intermediate transfer belt.

In addition, when a plurality of color images are not overlayed correctly in an image forming apparatus a color displacement will occur, and degrade an image quality.

Several factors are critical for a correct overlaying of the plurality of color images. The most important factor is variations of the traveling speed of a belt such as a sheet transport belt or an intermediate transfer belt. Suppressing the variation in the traveling speed of the belt is critical to improve precision for overlaying the plurality of color images, however, the variation in the traveling speed of the belt occurs by several causes.

For example, with the demand of miniaturization of an apparatus, dimensions between each unit in the image forming apparatus becoming smaller. Therefore, variation in the traveling speed of the belt such as a sheet transport belt or an intermediate transfer belt may occur with an influence of the heat generated at a heat source such as a fixing device.

To eliminate such heat influence, providing heat pipes to rollers extending the belt to indirectly cool the belt is proposed. However, such a solution leads to a complication of the configuration, and also to an increase of the manufacturing cost of the image forming apparatus.

Furthermore, a sensor to detect a traveling speed of the belt may be provided to stabilize the traveling speed of the belt based on an output signal from the sensor. However, the traveling speed of the belt may not be detected correctly by the heat expansion of the sensor.

SUMMARY OF THE INVENTION

In view of the foregoing, it is an object of the present invention to provide a novel method and apparatus capable of effectively reducing unevenness of density and color displacement of images by controlling a speed of a transfer member with high precision.

To achieve the above object, in one example, a novel image forming apparatus includes at least one image carrying member, a transfer member, a plurality of support rollers, a detecting mechanism, and a controller. The at least one image carrying member is configured to form a toner image on a surface thereof. The transfer member has a surface facing the at least one image carrying member and is configured to transfer the toner image to a recording medium. The plurality of support rollers supports the transfer member. The detecting mechanism includes a detection roller, a roller shaft, a moving member, and a sensor, and is configured to detect a speed of the transfer member. The detection roller includes at least one support roller selected from the plurality of support rollers. The roller shaft is provided to the detection roller. The moving member is configured to rotate with the detection roller and directly fixed to the roller shaft. The sensor is configured to detect a moving speed of the detection roller with the moving member, and the controller is configured to control a traveling speed of the transfer member to a target speed based on a detection result of the sensor.

In the above-mentioned image forming apparatus, the transfer member may include an intermediate transfer belt configured to transfer the toner image to a recording medium, or a sheet transport belt configured to transfer the toner image to a recording medium.

In the above-mentioned image forming apparatus, the detection roller and the moving member are arranged such that a maximum radius point of the detection roller against a central axis line of the roller shaft and a minimum radius point of the moving member against a central axis line of the roller shaft are positioned in directions substantially equal to each other.

The moving member is provided with a mark indicating the minimum radius point of the moving member against the central axis line of the roller shaft.

In the above-mentioned image forming apparatus, the detection roller and the moving member are arranged such that a minimum radius point of the detection roller against the central axis line of the roller shaft and a maximum radius point of the moving member against the central axis line of the roller shaft are positioned in directions substantially equal to each other.

The moving member is provided with a mark indicating the maximum radius point of the moving member against the central axis line of the roller.

In the above-mentioned image forming apparatus, the detecting mechanism is arranged to a specific position that is not susceptible to heat. The specific position that is not susceptible to heat is remote from a heat source of the image forming apparatus.

In the above-mentioned image forming apparatus, the heat source includes at least one of a fixing device and an optical writing device.

In the above-mentioned image forming apparatus, the moving speed of the moving member is a rotation speed of the detection roller. The moving member and the detection roller form an encoder. The detection roller is disposed at a most remote position from the heat source.

In the above-mentioned image forming apparatus, the plurality of support rollers includes at least one support roller which switches between different positions to tilt the surface of the transfer member, and at least one support roller which is fixedly positioned.

In the above-mentioned image forming apparatus, the detection roller is one of the at least one support roller which is fixedly positioned and disposed at a most remote position from the heat source.

In the above-mentioned image forming apparatus, the plurality of support rollers includes at least one drive roller, and at least one tension roller disposed between the detection roller and the at least one drive roller.

In the above-mentioned image forming apparatus, the detecting mechanism may further include an encoder case, and the encoder is sealed in the encoder case.

In the above-mentioned image forming apparatus, a multiplication of a circumference length of the detection roller by a positive integer is equal to a transfer pitch distance of the at least one image carrying member.

In the above-mentioned image forming apparatus, the detection roller includes a material having a diameter expansion rate of 0.05% or less against temperature.

In the above-mentioned image forming apparatus, a work required to raise temperature by one Celsius degree calculated from a type and used amount of a material of the detection roller is substantially 30 Joule or more.

In the above-mentioned image forming apparatus, a linear expansion coefficient of a material of the detection roller is substantially $25\times10^{-6}$ (1/° C.) or less.

In the above-mentioned image forming apparatus, a moment of inertia of the detection roller is substantially 35 ($kgf\cdot cm^2$) or less.

In the above-mentioned image forming apparatus, the detection roller may include aluminum, iron, stainless, INVAR (Fe—Ni), and carbon fiber.

Another novel image forming apparatus capable of forming a color image, in one example, includes a photo-conductive member in a belt shape, a plurality of developing devices, an intermediate transfer member, a fixing device, and a detecting mechanism.

The photo-conductive member in a belt shape is configured to form a plurality of electrostatic latent color images. The plurality of developing devices are arranged to face the photo-conductive member and configured to develop the electrostatic latent color images into a plurality of toner color images. The intermediate transfer member is arranged to contact with the photo-conductive member, and configured to sequentially receive the plurality of toner color images from the photo-conductive member and to transfer the plurality of toner color images to a recording medium. The fixing device is configured to fix the plurality of toner color images transferred to the recording medium. The detecting mechanism is configured to detect a traveling speed of the photo-conductive member and arranged to a specific position that is not susceptible to heat.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 22A and 22B are tables of physical properties of materials used for the detection roller.

DETAILED DESCRIPTION OF PREFERRED EMBODIMENTS

Figure 1:
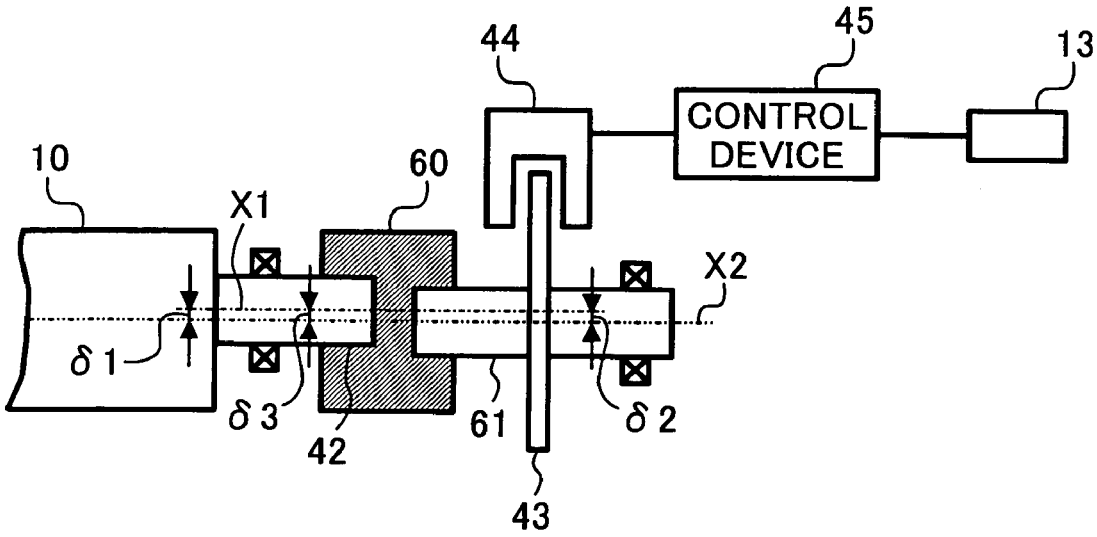
FIG. 1 PRIOR ART
FIG. 1 is an encoder and associated parts used for a conventional image forming apparatus.

In describing preferred embodiments illustrated in the drawings, specific terminology is employed for the sake of clarity. However, the disclosure of the present patent specification is not intended to be limited to the specific terminology so selected and it is to be understood that each specific element includes all technical equivalents that operate in a similar manner.

Figure 2:
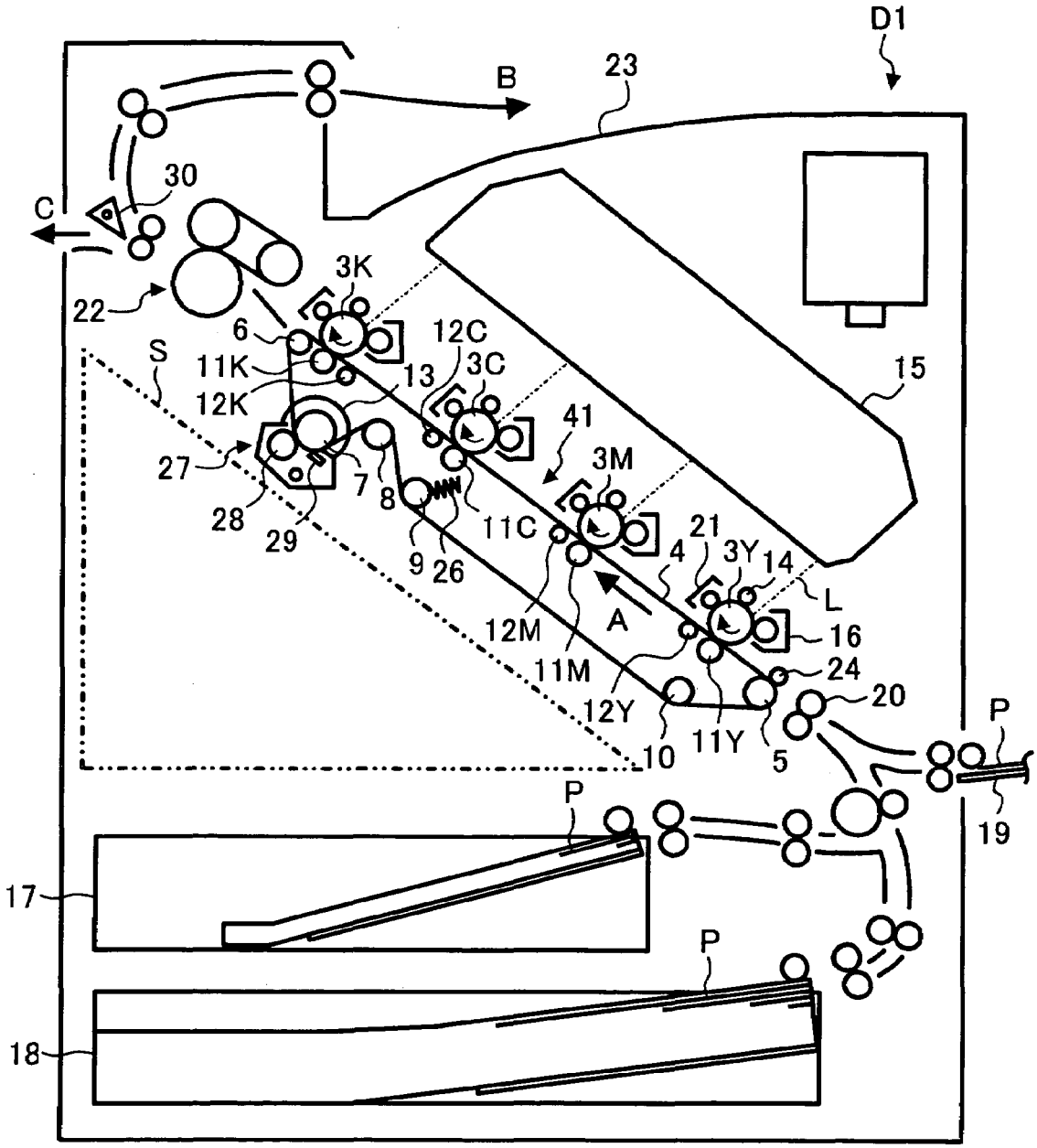
FIG. 2 is an exemplary cross sectional view of an image forming apparatus according to an exemplary embodiment of the present invention, using a direct transfer method.

Referring now to the drawings, wherein like reference numerals designate identical or corresponding parts throughout the several views, and more particularly to FIG. 2 thereof, an exemplary image forming apparatus according to an exemplary embodiment of the present invention is described.

FIG. 2 is a schematic drawing of an image forming apparatus using a direct transfer method.

The image forming apparatus includes a plurality of image carrying members 3Y, 3M, and 3C, and 3K installed in a body D1 of the image forming apparatus, and each of the image carrying members 3Y, 3M, and 3C, and 3K is made of a photo-conductive member in a drum shape.

Each of the image carrying members 3Y, 3M, and 3C, and 3K form a different toner image. In an example illustrated in the drawing, the image carrying members 3Y, 3M, and 3C form a yellow toner image, a magenta toner image, and a cyan toner image on their surfaces, respectively, and the image carrying member 3K forms a black toner image. The image carrying members 3Y, 3M, 3C, and 3K are arranged in series with a predetermined transfer pitch distance with each other.

A sheet transport belt 4 of an endless belt type is arranged such that it faces each of the image carrying members 3Y, 3M, 3C, and 3K.

Each of transfer rollers 11Y, 11M, 11C, and 11K is arranged in a position opposing each of the image carrying members 3Y, 3M, 3C, and 3K, respectively, by sandwiching the sheet transport belt 4 between the image carrying members and the transfer rollers.

Each of back-up rollers 12Y, 12M, 12C, and 12K is arranged in a position close to each of the transfer rollers 11Y, 11M, 11C, and 11K, respectively.

The sheet transport belt 4 of an endless belt type is extended to the transfer rollers 11Y, 11M, 11C, and 11K, the back-up rollers 12Y, 12M, 12C, and 12K, and a plurality of support rollers 5, 6, 7, 8, 9, and 10.

The support roller 7 is configured as a drive roller 7, and the drive roller 7 is driven by a drive motor 13. The sheet transport belt 4 is traveled to a traveling direction A by the drive roller 13.

At least one of the plurality of support rollers is configured as a drive roller, and more than one support rollers may be configured as drive rollers in some cases.

The support roller 8 is disposed at a downstream position of the traveling direction A of the sheet transport belt 4 with respect to the drive roller 7.

The support roller 8 pushes an outer surface of the sheet transport belt 4 to enlarge an extending angle of the drive roller 7 to the sheet transport belt 4.

The support roller 9 is disposed at a downstream position of the traveling direction A of the sheet transport belt 4 with respect to the support roller 8, and a spring 26 pushes the support roller 9 to the back surface of a sheet transport belt 4 to give a tension to the sheet transport belt 4.

The sheet transport belt 4 is an endless single-layer belt, and made of polyvinylidene fluoride (PVDF), for example, having a high volume resistivity of $10^9$ through $10^{11}$ Ωcm. The sheet transport belt 4 is arranged to face and contact the surfaces of the image carrying members 3Y, 3M, 3C, and 3K.

Because a substantially similar configuration is used for forming a toner image on each of the image carrying members 3Y, 3M, 3C, and 3K, a configuration for forming a toner image on the image carrying member 3Y is described hereinafter as the representative of the image carrying members.

The image carrying member 3Y illustrated in FIG. 2 is rotationally driven to a clockwise direction, and a surface of the image carrying member 3Y is electrically charged with a predetermined polarity by a charging device 14 during such a rotation. A writing light L of laser light emitted from an exposure device 15 is irradiated on such an electrically charged surface to form an electrostatic latent image on the surface of the image carrying member 3Y, and a development device 16 develops the electrostatic latent image as the yellow toner image.

On one hand, a recording sheet (recording medium) P made of a transfer paper, a resin film or the like is fed from either sheet feeding cassettes 17 and 18 provided in a lower part of the body D1 of the image forming apparatus, or a manual feed table 19.

The recording sheet P is fed to a space between the image carrying member 3Y and the sheet transport belt 4 traveling to the traveling direction A by rotation of a pair of registration rollers 20 at a predetermined timing, and the recording sheet P is carried and transported on the sheet transport belt 4.

The transfer roller 11Y is disposed at a position facing the image carrying member 3Y. On the surface of the transfer roller 11Y, a transfer voltage is applied. The transfer voltage has an opposite polarity of the charge of the toner image formed on the surface of the image carrying member 3Y. In this way, the yellow toner image on the surface of the image carrying member 3Y is transferred to the surface of the recording sheet P.

Some toners are not transferred to the recording sheet P and remain on the surface of the image carrying member 3Y. A cleaning device 21 removes such remaining toners from the surface of the image carrying member 3Y.

Similarly, each of a magenta toner image, a cyan toner image, and a black toner image is formed on each surface of the image carrying members 3M, 3C, and 3K in FIG. 2, respectively. These toner images are sequentially transferred and overlayed to the surface of the recording sheet P already having the yellow toner image by actions of the transfer rollers 11M, 11C, and 11K.

In this way, a synthesized toner image of four colors is formed on the recording sheet P.

Then, the recording sheet P leaves the sheet transport belt 4, passes through a fixing device 22 to fix the toner images on the recording sheet P by actions of heat and pressure applied to the recording sheet P when passing through the fixing device 22.

As indicated by an arrow B, the recording sheet P passed through the fixing device 22 is ejected to a sheet discharging part 23. In this case, the recording sheet are stacked on the sheet discharging part 23 with a face-down state in which a surface having a image faces the sheet discharging part 23.

The support roller 5 is disposed at a position most upstream of the sheet transport belt 4, at which the recording sheet P passes through. The support roller 5 is also referred to as an entrance roller 5, as required.

The support roller 6 is disposed at a position most downstream of the sheet transport belt 4. The support roller 6 is also referred to as an exit roller 6, as required.

A charging roller 24 is arranged adjacent to the entrance roller 5 while sandwiching the sheet transport belt 4 between the charging roller 24 and the entrance roller 5.

Figure 3:
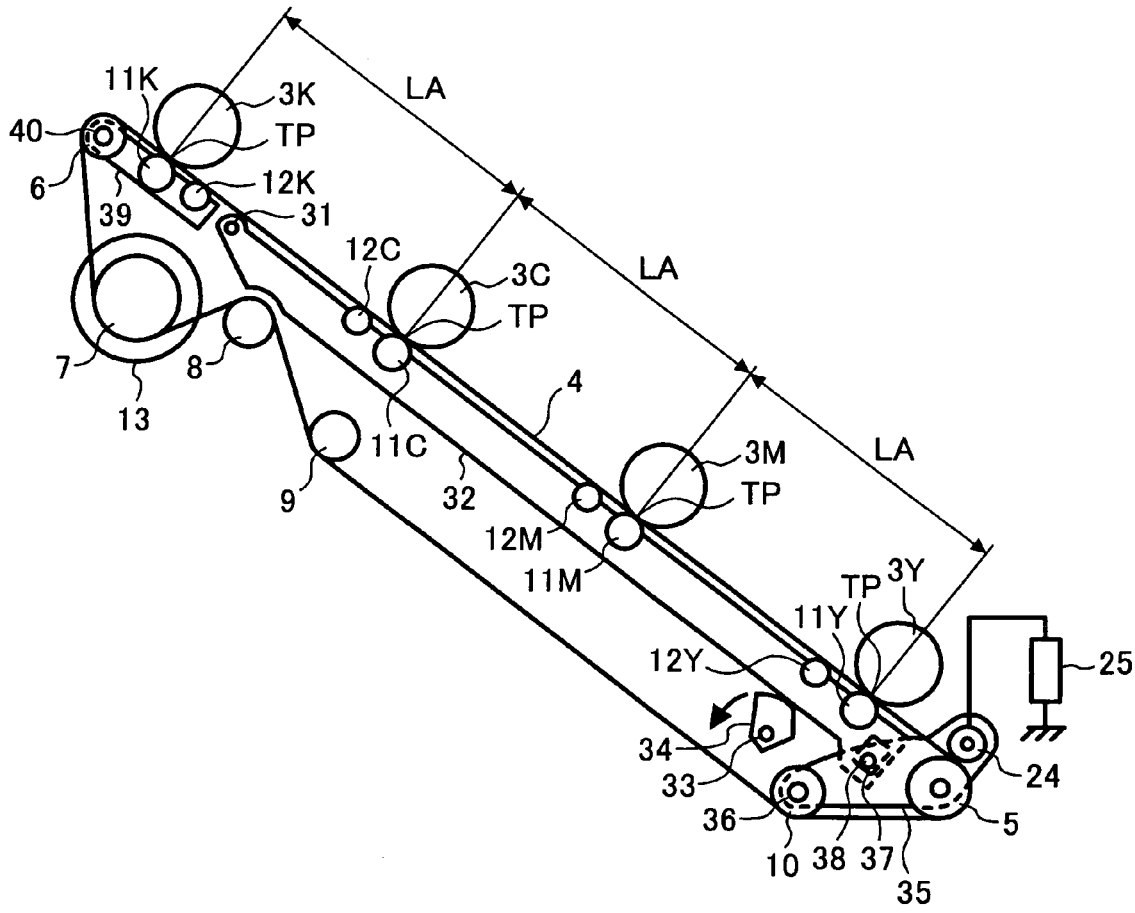
FIG. 3 is an exemplary schematic view of image carrying members, support rollers, and related components in FIG. 2.

As illustrated in FIG. 3, a power source 25 supplies a predetermined voltage to the charging roller 24. With such a configuration, the recording sheet P passed through the charging roller 24 is electro-statically adsorbed on the surface of the sheet transport belt 4, and thus securely carried and transported on the sheet transport belt 4.

The exposure device 15 includes a light source, a polygon mirror, an f-theta lens, a reflection mirror, and irradiates laser with a scan mode on surfaces of the image carrying members based on image data.

Each of the transfer rollers 11Y, 11M, 11C, and 11K is made of a roller provided with a sponge or the like on the surface of the roller, and a transfer voltage is supplied to a core metal of the transfer roller from a power source (not shown). The transfer roller rotates while making contact with a back surface of the sheet transport belt 4.

The above-mentioned back-up rollers 12Y, 12M, 12C, and 12K are provided to each of transfer positions, at which the toner image is transferred from each of the image carrying members to the recording sheet P, such that the recording sheet P and each of the image carrying member make a proper contact to obtain a best transfer nip.

Furthermore, a toner bottle, a double sided copying unit, a sheet reversing unit, a power source unit or the like (not shown) are provided to an area S encircled by two-dot chain line in FIG. 2.

A pawl 30 is provided downstream of the fixing device 22 to switch directions of the recording sheet P.

When the pawl 30 is switched in one direction, the recording sheet P passed through the fixing device 22 is transported in an arrow direction C, and fed to a post-processing device (not shown) such as a sorter and a stitching or stapling device.

When the pawl 30 is switched in another direction, the recording sheet P is fed to a switch-back portion, and later fed to each of the image carrying members after passing through the pair of registration rollers 20 again for double sided printing, in which a toner image is transferred to a back surface of the recording sheet P, and such toner image is fixed by the fixing device 22. The recording sheet P passed through the fixing device 22 is ejected to the sheet discharging part 23.

A belt cleaning device 27 in FIG. 2 includes a brush roller 28 and a cleaning blade 29 contacting an outer surface of the sheet transport belt 4 extended to the drive roller 7. The brush roller 28 and the cleaning blade 29 remove foreign materials such as toner or the like adhered on the sheet transport belt 4.

As illustrated in FIG. 3, the transfer rollers 11Y, 11M, and 11C and the adjacently provided back-up rollers 12Y, 12M, and 12C are supported on a bracket 32. The bracket 32 can pivot at a shaft 31. A cam 34 fixed to a cam shaft 33 contacts the bracket 32. The bracket 32 rotates around the shaft 31 in a clockwise direction when the cam 34 rotates in an arrow direction indicated in FIG. 3.

The entrance roller 5 and the charging roller 24 are supported on an entrance bracket 35, which can pivot at a shaft 36.

Furthermore, a hole 37 formed in the bracket 32 engages with a pin 38 fixed to the entrance bracket 35.

When the bracket 32 rotates at the shaft 31 as described above, the entrance bracket 35 interlockingly rotates at the shaft 36 in a clockwise direction.

When both of the bracket 32 and the entrance bracket 35 rotate in such a direction, the transfer rollers 11Y, 11M, and 11C and the back-up rollers 12Y, 12M, and 12C move away from the image carrying members 3Y, 3M, and 3C.

The entrance roller 5 and the charging roller 24 also move in a downward direction greatly, and the sheet transport belt 4 moves away from the image carrying members 3Y, 3M, and 3C.

Under such a condition, only a black toner image is formed on the image carrying member 3K, and a monochrome mode is conducted to transfer such a monochrome toner image to a recording sheet P.

When the monochrome mode is conducted, the recording sheet P transported by the sheet transport belt 4 does not contact the image carrying members 3Y, 3M, and 3C. The rotation of the image carrying member 3Y, 3M, and 3C are stopped, and only the image carrying member 3K is driven.

The transfer roller 11K and the adjacently provided back-up roller 12K are supported by an exit bracket 39. The exit bracket 39 can pivot at a shaft 40, which is coaxial with the exit roller 6.

As illustrated in FIG. 2, the sheet transport belt 4, a plurality of support rollers supporting the sheet transport belt 4, and the belt cleaning device 27 are configured integrally as a transfer unit 41, which is detachable from the body D1 of the image forming apparatus.

The transfer unit 41 is detached from the body D1 of the image forming apparatus in a following procedure.

At first, the bracket 32 is rotated as described above to move the sheet transport belt 4 away from the image carrying members 3Y, 3M, and 3C, and the exit bracket 39 is rotated in a clockwise direction by a handle (not shown) to move the transfer roller 11K and the back-up roller 12K away from the image carrying member 3K, and move the sheet transport belt 4 away from the image carrying member 3K.

Hereinafter, at least one support roller of the plurality of support rollers for the sheet transport belt 4 is designated as a detection roller.

The detection roller is used to prevent an unevenness of density in the toner images transferred to the recording sheet P from the image carrying members 3Y, 3M, 3C, and 3K, and to prevent a color displacement in a synthesized toner image transferred to the recording sheet P.

As described below, the drive motor 13 controls a traveling speed of the sheet transport belt 4 at a stable level by detecting the speed of the detection roller. In FIG. 2, the support roller 10 is configured as a detection roller. The support roller 10 is referred to as the detection roller 10, as required hereinafter.

Figure 4:
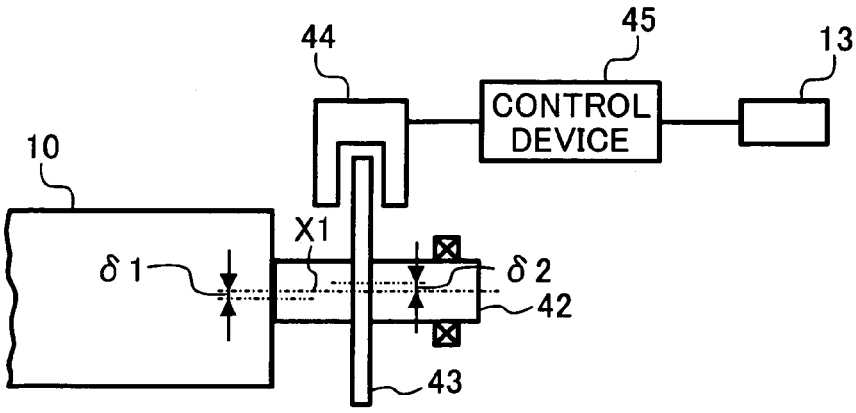
FIG. 4 is an exemplary encoder and associated parts according to an exemplary embodiment of the present invention, provided to a detection roller of the image forming apparatus in FIG. 2.

As illustrated in a detecting mechanism in FIG. 4, the detection roller 10 is fixed to a roller shaft 42. The roller shaft 42 is provided with a slit disk 43 in a circular plate shape, which is a moving member. The slit disk 43 rotates with a detection roller 10.

In addition, a photo sensor 44 detecting a moving speed of the slit disk 43, and a control device 45 are provided in the detecting mechanism in FIG. 4. The photo sensor 44 has a light-emitting element and a light-receiving element disposed at positions that sandwich the slit disk 43 between a space of the light-emitting element and the light-receiving element.

Figure 5:
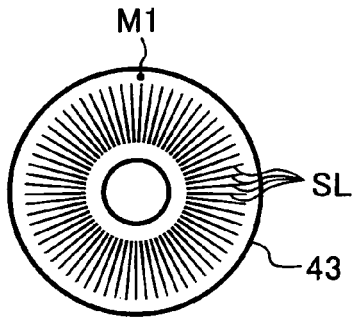
FIG. 5 is an exemplary front view of a slit disk used for the encoder in FIG. 4.

The slit disk 43 is made of a transparent material, and has a number of detection lines SL formed in radial directions at a same pitch as illustrated in FIG. 5.

When the slit disk 43 rotates with the detection roller 10, and a transparent part between two adjacent detection lines SL coincides with the space between the light-emitting element and the light-receiving element, a light emitted from the light-emitting element enters the light-receiving element.

On the other hand, when a detection line SL coincides with the space between the light-emitting element and the light-receiving element, a light emitted from the light-emitting element is blocked by the detection line SL. Thus, the light emitted from the light-emitting element does not enter the light-receiving element.

As described above, the slit disk 43 and the photo sensor 44 form an encoder.

Based on detection results obtained by the sensor including the photo sensor 44, the drive motor 13 is controlled by an output signal of the control device 45 so that a traveling speed of the sheet transport belt 4 becomes a target speed.

Accordingly, the drive motor 13 is controlled such that the moving speed of the slit disk 43 is maintained at a stable level, and consequently, the traveling speed of the sheet transport belt 4 is maintained at a stable level.

In the detecting mechanism of FIG. 4, the detection roller 10 and the slit disk 43 are each concentrically coupled to the roller shaft 42.

However, the detection roller 10 has a slight eccentricity δ1 against a central axis line X1 of the roller shaft 42, and the slit disk 43 has also a slight eccentricity δ2 against a central axis line X1 of the roller shaft 42.

The detecting mechanism of FIG. 4 according to an exemplary embodiment of the present invention has a measure to cope with such a situation.

In FIG. 3, a transfer position TP is a position in which the toner image is transferred to the recording sheet P, and a transfer pitch distance between two adjacent image carrying members is indicated as LA.

The transfer pitch distance LA is set to a length gained by multiplying a circumference length of the detection roller 10 with a substantially positive integer. By employing such a configuration, a color displacement on the synthesized toner image transferred to the recording sheet P can be prevented at a certain level.

In the detecting mechanism according to an exemplary embodiment illustrated in FIG. 4, the moving member formed of the slit disk 43 is directly fixed to the roller shaft 42, which supports the detection roller 10.

Accordingly, an accumulation of eccentricities of the detecting mechanism according to an exemplary embodiment becomes smaller than that of the conventional detecting mechanism, and an occurrence of the unevenness of density can be effectively suppressed.

In other words, even if the detection roller 10 has eccentricity against the roller shaft 42, and the slit disk 43 has eccentricity against the roller shaft 42, the total eccentricities of the detecting mechanism of FIG. 4 becomes smaller than that of the conventional detecting mechanism.

Therefore, even if the variations in a speed of the slit disk 43 caused by the above-mentioned eccentricities is erroneously detected as the variation in traveling speed of the sheet transport belt 4 which does not actually occur, and the drive motor 13 is controlled based on such erroneous detection to eliminate the variation in speed of the slit disk 43, the unevenness of density occurring to the toner image transferred to the recording sheet P from each of the image carrying members 3Y, 3M, 3C, and 3K can be reduced to a level that cannot be perceived by human eyes, thus an image quality of the finished color image can be improved.

Furthermore, the coupling 60 used in the detecting mechanism in FIG. 1 can be omitted in the detecting mechanism in FIG. 4, thus the total number components are reduced and the assembly work for the coupling 60 can be eliminated. Therefore, the detecting mechanism in FIG. 4 can achieve a cost reduction.

In order to further reduce the above-described unevenness of density, a configuration that reduces the accumulation of the eccentricity δ1 of the detection roller 10 and the eccentricity δ2 of the slit disk 43 against the central axis line X1 of the roller shaft 42 of FIG. 4 is required.

To cope with this situation, a process of improving the manufacturing precision of the detection roller 10, the roller shaft 42, and the slit disk 43 can be employed to substantially eliminate the above-described eccentricities δ1 and δ2, however, such processes inevitably increase the manufacturing cost.

Hereinafter, an exemplary measure for the above-mentioned situation will be explained with FIG. 6.

Figure 6:
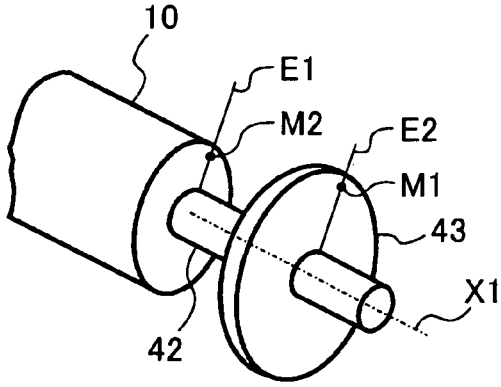
FIG. 6 is an exemplary perspective view of the detection roller, a roller shaft, and the slit disk for explaining their relative positional relationship.

In FIG. 6, a point M2 represents a maximum radius of the detection roller 10 along a radial line E1 extending perpendicularly from the central axis line X1 of the roller shaft 42, and a point M1 represents a minimum radius of the slit disk 43 along a radial line E2 extending perpendicularly from the central axis line X1 of the roller shaft 42.

When the radial lines E1 and E2 are substantially matched in the radial directions of the detection roller 10 and the slit disk 43 (i.e. at substantially the same radial angle about the central axis line X1), and the slit disk 43 is fixed to the roller shaft 42 at this position, the total accumulation of the eccentricities becomes smaller because the eccentricities δ1 and δ2 can cancel out each other even if the eccentricities δ1 and δ2 are more or less large. Therefore, the unevenness of density of the image is effectively suppressed to a level that cannot be perceived by human eyes.

A similar effect can be achieved when a minimum radius of the detection roller 10 against the central axis line X1 of the roller shaft 42 and a maximum radius of the slit disk 43 against the central axis line X1 of the roller shaft 42 are substantially matched in the radial directions of the detection roller 10 and the slit disk 43, and the slit disk 43 is fixed to the roller shaft 42.

Hereinafter, an exemplary method for positioning and assembling the slit disk 43 to the roller shaft 42 will be explained.

At fist, fix the roller shaft 42 to the detection roller 10, and temporally fix the slit disk 43 to the roller shaft 42.

Next, rotate the detection roller 10, the roller shaft 42, and the slit disk 43 altogether, and monitor an output signal of the photo sensor 44.

In FIGS. 7A through 7D, the horizontal axis represents the radial position of the detection roller 10 and the slit disk 43, and the vertical axis represents the amount of eccentricity of the detection roller 10 and the slit disk 43.

Figure 7A:
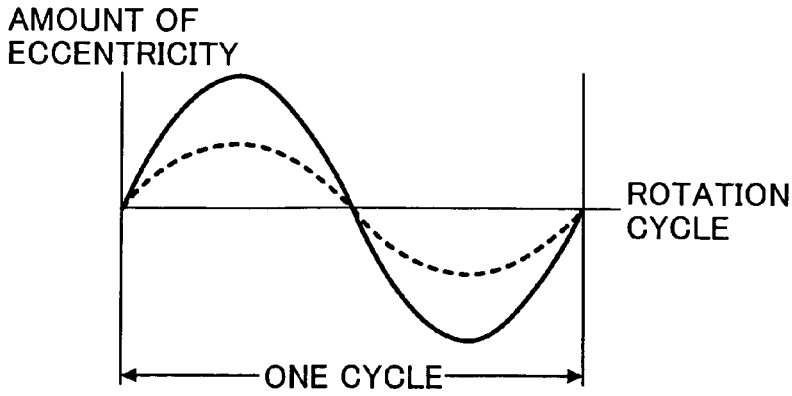
FIGS. 7A, 7B, 7C, and 7D are exemplary graphs showing the amount of the eccentricities of the detection roller and the slit disk.

In FIG. 7A, a solid line represents the eccentricity of the detection roller 10, and a dotted line represents the eccentricity of the slit disk 43 when the slit disk 43 is fixed to the roller shaft 42 temporally.

Figure 7B:
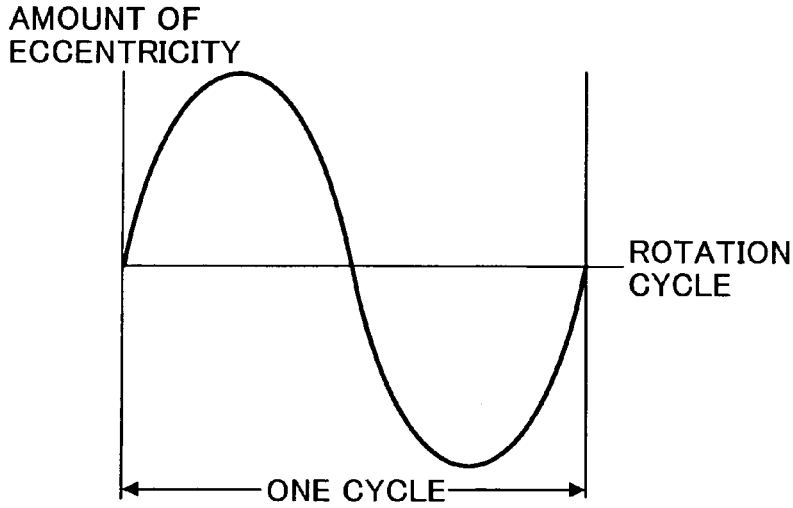

FIG. 7B shows an accumulated eccentricity of the above-mentioned two eccentricities of the detection roller 10 and the slit disk 43.

In the detecting mechanism in FIG. 4, the variation in speed of the slit disk 43 corresponding to such eccentricity is detected by the photo sensor 44, and monitored.

Next, rotate the slit disk 43 against the roller shaft 42, and change a relative angular position of the slit disk 43 with respect to the roller shaft 42. Similar procedures as described above are conducted, and monitor output signals of the photo sensor 44.

Repeat the above-described procedures, find a relative angular position of the slit disk 43 with respect to the roller shaft 42 at which the amplitude of the waveform shown in FIG. 7B becomes a minimum.

Figure 7C:
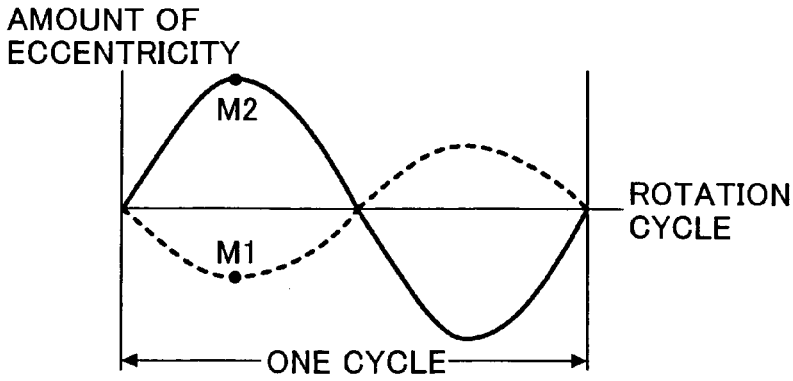
Figure 7D:
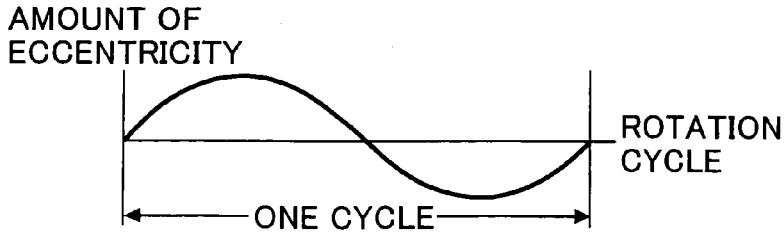

For example, find the position of the slit disk 43 in which the waveform becomes smaller as shown in FIG. 7D. Fix the slit disk 43 permanently to the roller shaft 42 at this position with adhesives, for example.

The above-described method can reduce the total accumulation of eccentricities.

However, the above-described method requires more or less bothersome procedures to find the best position of the slit disk 43 with respect to the roller shaft 42 for each time the slit disk 43 is to be fixed to the roller shaft 42.

Hereinafter, a method that can fix the slit disk 43 to the roller shaft 42 at an appropriate position more easily will be explained.

When the slit disk 43 is mass-produced with a same material and same processes, all pieces manufactured as the slit disk 43 have the same maximum radius point and the same minimum radius point with respect to the roller shaft 42.

Therefore, the maximum radius point and the minimum radius point of all pieces of the slit disk 43 can be identified by detecting the maximum radius point and the minimum radius point of only one piece.

Thus, as illustrated in FIG. 6, a mark M1 is put on all pieces of the slit disk 43 for the maximum radius point or the minimum radius point.

On one hand, the maximum radius point or the minimum radius point of the detection roller 10 against the central axis line X1 of the roller shaft 42 is identified for each time, and a mark M2 is put on the maximum radius point or the minimum radius point as shown in FIG. 6.

When the slit disk 43 is assembled to the roller shaft 42, the radial direction of the marks M1 and M2 are matched as shown in FIG. 6, and the slit disk 43 is fixed to the roller shaft 42 at this position with adhesives, for example.

In one case, put the mark M1 to the minimum radius of the slit disk 43 and the mark M2 to the maximum radius point of the detection roller 10. After matching the marks M1 and M2 to their radial direction, fix the slit disk 43 to the roller shaft 42 at this position.

Or in another case, put the mark M1 to the maximum radius point of the slit disk 43 and the mark M2 to the minimum radius point of the detection roller 10. After matching the marks M1 and M2 to their radial direction, fix the slit disk 43 to the roller shaft 42 at this position.

A solid line in FIG. 7C represents the amount of the eccentricity of the detection roller 10, and a dotted line represents the amount of the eccentricity of the slit disk 43.

By matching the positions of the marks M1 and M2, eccentricities of the detection roller 10 and the slit disk 43 cancel out each other, and the total accumulation of the eccentricities can be reduced as shown in FIG. 7D.

As described above, by putting the mark M1 to the minimum radius point or the maximum radius point of the slit disk 43 against the central axis line X1, the slit disk 43 can be assembled and fixed to the roller shaft at an appropriate position easily.

In the above discussion, an exemplary embodiment according to the present invention is applied to the image forming apparatus using the direct transfer method, in which each of the toner images formed on the each of the surfaces of the each of the image carrying members 3Y, 3M, 3C, and 3K is overlayingly and sequentially transferred to the recording sheet P carried and transported on the sheet transport belt 4 to obtain the record image.

In addition to the above method, a configuration according to the present invention can be also applied to an image forming apparatus using an intermediate transfer method, in which each of the toner images formed on the each of the surfaces of the each of the image carrying members is overlayingly and sequentially transferred to a intermediate transfer belt at first, and is transferred to the recording sheet P to obtain a record image.

Figure 8:
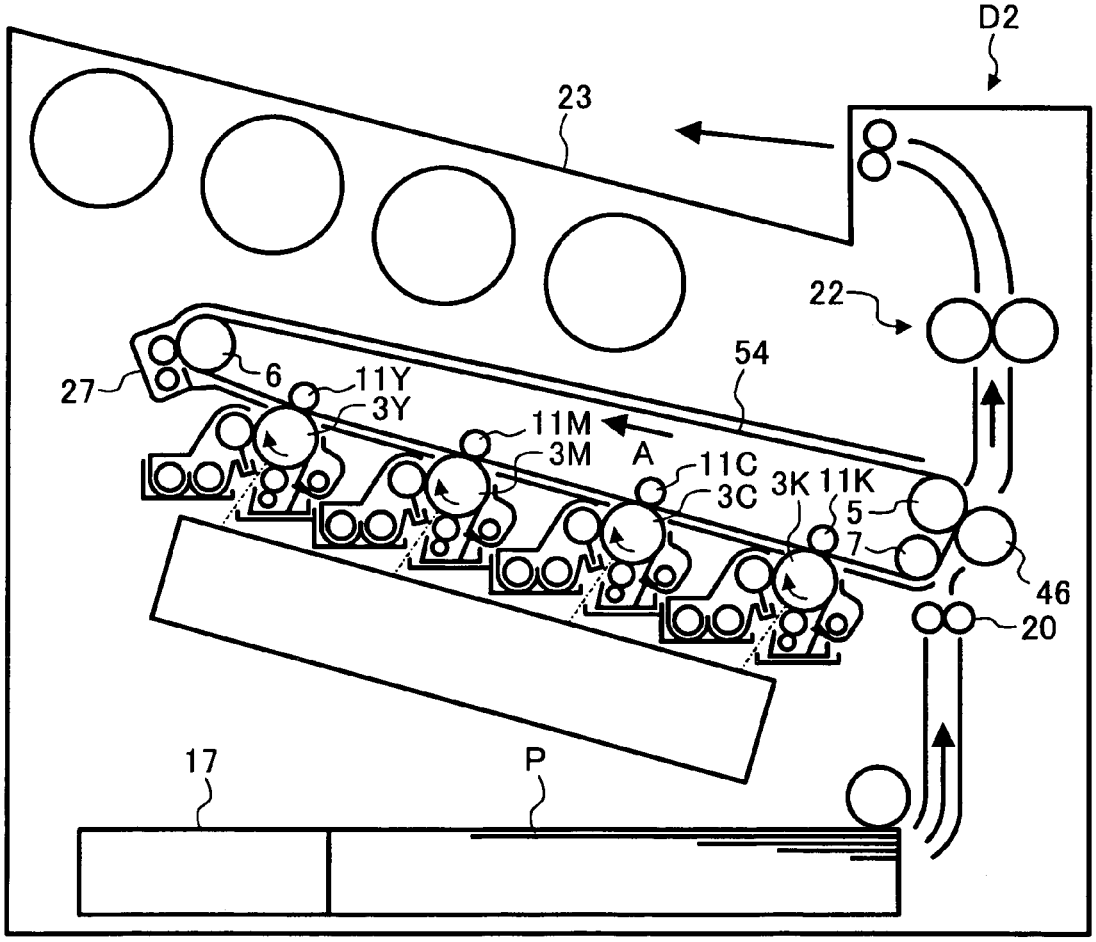
FIG. 8 is an exemplary schematic view of an image forming apparatus according to another exemplary embodiment of the present invention, using an intermediate transfer method.

FIG. 8 is an exemplary image forming apparatus using an intermediate transfer method.

Similarly to the image forming apparatus of FIG. 2, the image forming apparatus of FIG. 8 forms different color toner images on each of the surfaces of the image carrying members 3Y, 3M, 3C, and 3K installed in a body D2 of the image forming apparatus.

Each of the toner images is overlayingly and sequentially transferred to an intermediate transfer belt 54. The intermediate transfer belt 54 faces the image carrying members 3Y, 3M, 3C, and 3K, and is extended to a plurality of support rollers 5, 6, and 7, and transfer rollers 11Y, 11M, 11C, and 11K, and travels in a traveling direction A.

At least one support roller of the plurality of support rollers for the intermediate transfer belt 54 is configured as a drive roller. In FIG. 8, the support roller 5 is designated as the drive roller. The drive roller 5 is driven by a drive motor (not shown) to drive the intermediate transfer belt 54.

The recording sheet P is fed from a sheet feeding cassette 17 by a pair of registration rollers 20, and transported to a space between the intermediate transfer belt 54 and a transfer roller 46 to transfer the toner images to the intermediate transfer belt 54.

After the transfer of the toner images, the intermediate transfer belt 54 is cleaned by a belt cleaning device 27.

The recording sheet P having transferred toner images passes through a fixing device 22 to fix the toner image on the recording sheet P. The recording sheet P passed through the fixing device 22 is ejected to a sheet discharging part 23.

Any components and methods explained in FIGS. 4 through 7 can be also employed to the image forming apparatus of FIG. 8.

Furthermore, the present invention can be applied to an image forming apparatus, which forms a monochrome toner image on one image carrying member and transfers the toner image to a recording sheet carried and transported on a sheet transport belt or to an intermediate transfer belt to obtain a record image.

The present invention can be applied to another image forming apparatus, which forms different color toner images on one image carrying member sequentially, and transfers each of the toner images overlayingly to a recording sheet carried and transported by a sheet transport belt to obtain a record image, or transfers each of the toner images overlayingly to an intermediate transfer belt, and transfers a synthesized toner image to a recording sheet to obtain a record image.

As described above, the present invention can be applied to an image forming apparatus having at least one image carrying member, wherein the image forming apparatus forms a toner image on the at least one image carrying member and transfers the toner image to a recording sheet carried and transported on a sheet transport belt to obtain a record image, or the image forming apparatus forms a toner image on the at least one image carrying member, transfers the toner image to an intermediate transfer belt, and transfers the toner image to a recording sheet to obtain a record image.

The present invention can effectively suppress the occurrence of an unevenness of density in a toner image transferred to a recording sheet or an intermediate transfer belt from an image carrying member, and can improve image quality of the toner image.

Figure 9:
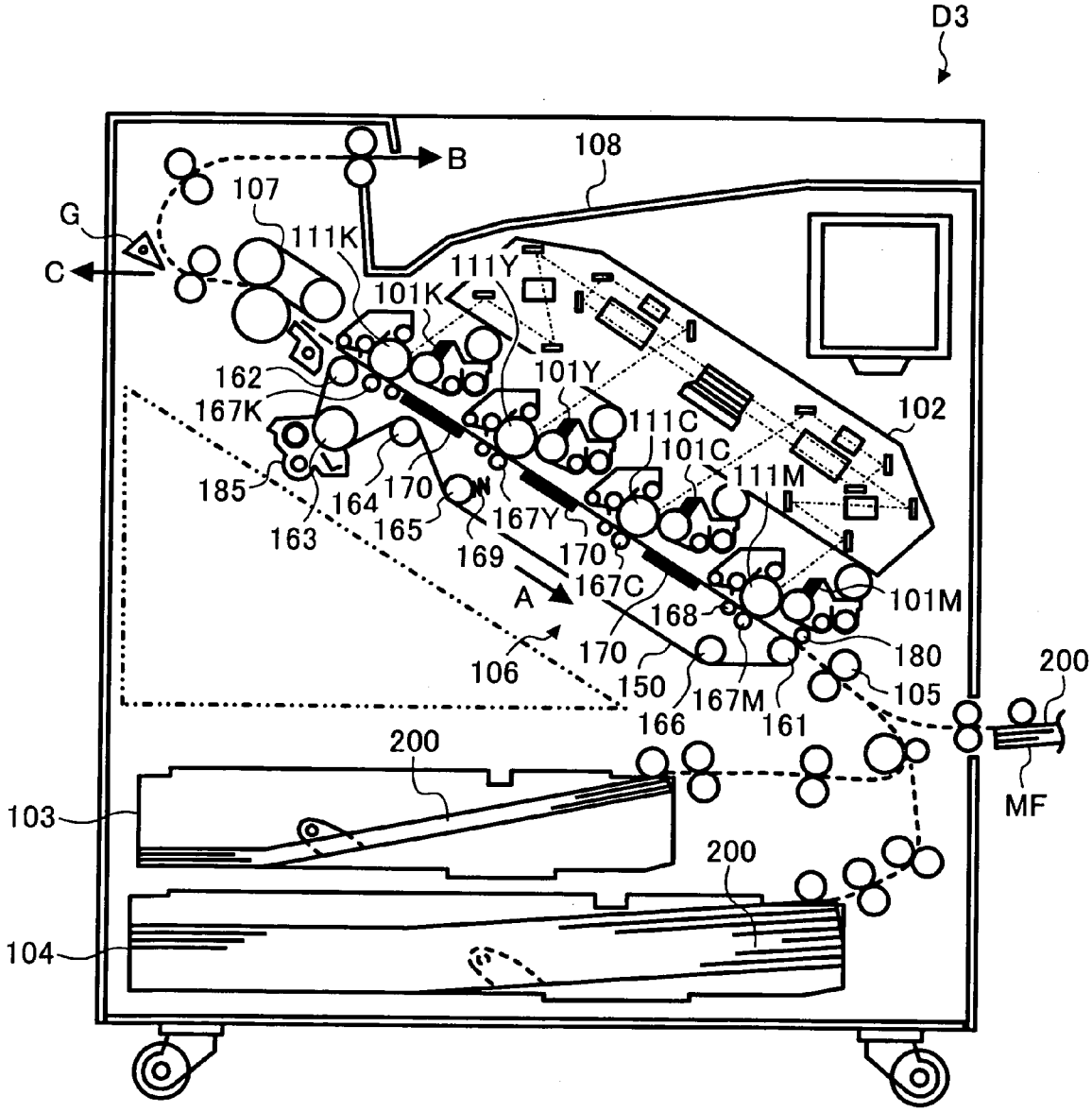
FIG. 9 is an exemplary schematic cross sectional view of an image forming apparatus according to another exemplary embodiment of the present invention.

FIG. 9 is an exemplary schematic cross sectional view of an image forming apparatus of a tandem type according to an another exemplary embodiment of the present invention.

The image forming apparatus includes sheet feeding parts (sheet feeding cassettes 103 and 104) provided to a lower part of a body D3 of the image forming apparatus, an image forming portion provided to a part above the sheet feeding part, and a sheet discharging part (sheet ejection tray 108) provided on the upper face of the body D3.

A dotted line of FIG. 9 shows a transport route of a recording sheet. The recording sheet is fed from the sheet feeding parts.

An image formed by the image forming portion is transferred to the recording sheet and fixed at a fixing device 107, and the recording sheet is ejected to the sheet ejection tray 108.

In the image forming portion, a transfer unit 106 is provided with slanting the transfer unit 106 such that a paper feeding side thereof comes to a lower side and a paper discharge side thereof comes to a upper side of the transfer unit 106.

Along an upper traveling side of a transfer belt 150 of the transfer unit 106, four image forming units 101M, 101C, 101Y, and 101K for magenta (M), cyan(C), yellow (Y), and black (K), respectively, are arranged in parallel from the paper feeding side to the paper discharge side of the transfer unit 106.

Hereinafter, the transfer belt 150 functions as a sheet transport belt transporting a recording sheet thereon, or as an intermediate transfer belt carrying a toner image temporally. As for the brevity of the term expression, a belt having the above meaning will be termed as "transfer belt" for the following explanation.

Each of the image forming units 101M, 101C, 101Y, and 101K includes each of the photo-conductive members in a drum shape 111M, 111C, 111Y, and 111K as an image carrying member, respectively, and corresponding development units. The image forming units are arranged such that each of rotation shafts of each of the photo-conductive members is arranged in series with a predetermined transfer pitch distance in a traveling direction of a recording sheet 200.

The image forming apparatus also includes an optical writing unit 102, a pair of registration rollers 105, a manual feed tray MF, and a toner supply cartridge (not shown).

The optical writing unit 102 includes a light source, a polygon mirror, an f-theta lens, a reflection mirror, and irradiates laser with a scan mode on each surface of each of the photo-conductive members 111M, 111C, 111Y, and 111K based on image data.

Figure 10:
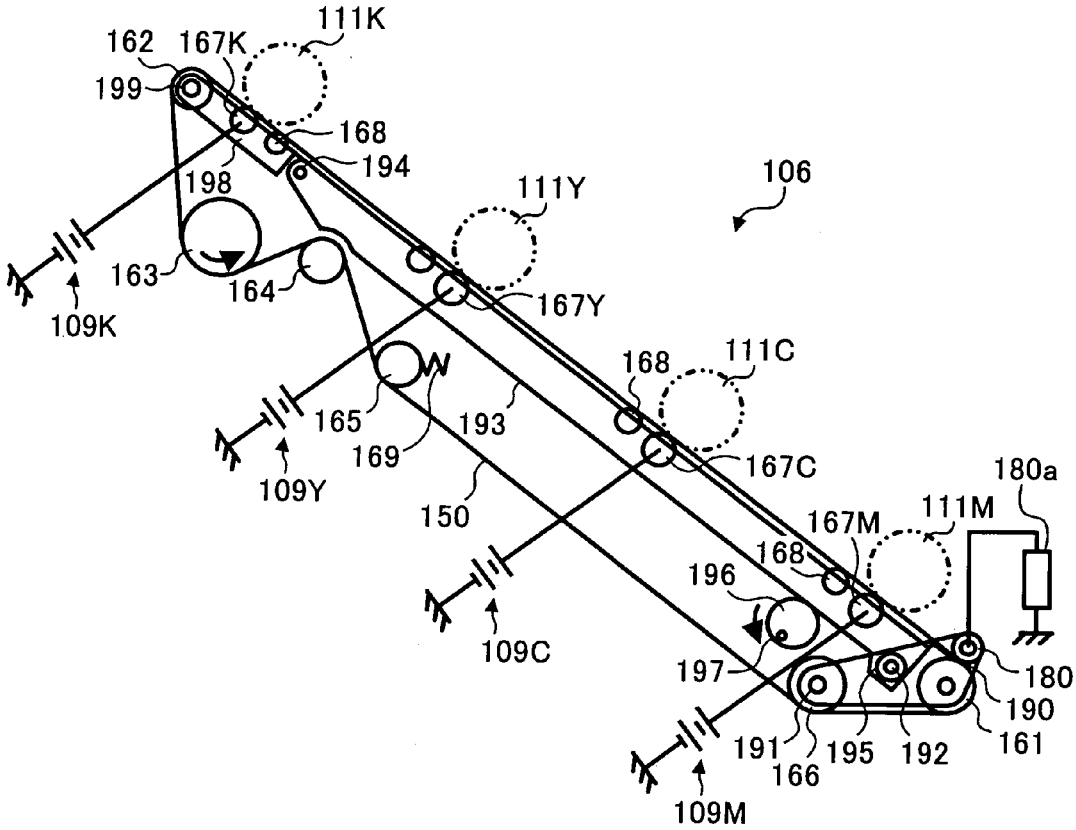
FIG. 10 is an exemplary enlarged view of a transfer unit in FIG. 9.

FIG. 10 is an exemplary enlarged view of the transfer unit 106.

The transfer unit 106 uses the transfer belt 150 of an endless single-layer belt. The transfer belt 150 is made of polyvinylidene fluoride (PVDF), for example, having a high volume resistivity of $10^9$ through $10^{11}$ Ωcm. The transfer belt 150 can be made of another material having a high elongation such as polyimide (PI)

The transfer belt 150 is extended to support rollers 161 through 168 so that the transfer belt 150 faces and contacts each of the transfer positions of each of the photo-conductive members 111M, 111C, 111Y, and 111K of each of the image forming units.

The support roller 161 disposed at an upstream of the traveling direction of the transfer belt 150 is designated as an entrance roller 161.

A charging roller 180 is disposed at a position opposing the entrance roller 161, and faces an outer surface of the transfer belt 150. A power source 180*a* supplies a predetermined voltage to the charging roller 180.

The recording sheet 200 passed through a space between the entrance roller 161 and the charging roller 180 is electrostatically adsorbed on the transfer belt 150.

The support roller 163 is a drive roller that frictionally drives the transfer belt 150, and is connected to a driver (not shown). The support roller 163 rotates in an arrow direction shown in FIG. 10.

Each of transfer bias applying members 167M, 167C, 167Y, and 167K is provided to a position, opposing each of the photo-conductive members in a drum shape 111M, 111C, 111Y, and 111K, as a transfer electric field generator that generates transfer electric field at each of transfer positions while contacting a back surface of the transfer belt 150.

Each of the transfer bias applying members 167M, 167C, 167Y, and 167K is a bias roller provided with a sponge or the like on its outer surface.

Each of transfer bias power sources 109M, 109C, 109Y, and 109K supplies a transfer bias to a roller core metal of each of the transfer bias applying members 167M, 167C, 167Y, and 167K.

Transfer charge is given to the transfer belt 150 by an action of the transfer bias which is applied, and a predetermined strength of a transfer electric field is generated between the transfer belt 150 and a surface of each of the photo-conductive members at a transfer position.

Furthermore, each of back-up rollers 168 is provided close to each of the transfer bias applying members 167M, 167C, 167Y, and 167K to maintain an appropriate contact between the recording sheet 200 and the photo-conductive members and to obtain the best transfer nip in which the transfer is conducted.

The transfer bias applying members 167M, 167C, and 167Y and the back-up rollers 168 are integrally provided to a bracket 193 while keeping movability of the transfer bias applying members and back-up rollers.

The bracket 193 can pivot at a shaft 194. The bracket 193 rotates in a clockwise direction when a cam 196 fixed to a cam shaft 197 rotates in an arrow direction in FIG. 10.

The entrance roller 161 and the charging roller 180 are supported integrally by an entrance roller bracket 190. The entrance roller bracket 190 can pivot at a shaft 191 in a clockwise direction from a state shown in FIG. 10.

A hole 195 provided to the bracket 193 and a pin 192 fixed to an entrance roller bracket 190 are engaged, and the entrance roller bracket 190 rotates interlockingly with the rotation of the bracket 193.

With the clockwise rotation of the entrance roller bracket 190 and the bracket 193, the transfer bias applying members 167M, 167C, and 167Y and their back-up rollers 168 move away from the photo-conductive members 111M, 111C, and 111Y, and the entrance roller 161 and the charging roller 180 also move downward.

A configuration of the image forming apparatus according to another exemplary embodiment in FIGS. 9 and 10 of the present invention allows for the disengaging of a contact of the photo-conductive members 111M, 111C, and 111Y and the transfer belt 150 when forming only a black image.

In another exemplary embodiment in FIGS. 9 and 10 of the present invention, when conducting a full color printing, the transfer belt 150 maintains contact with the photo-conductive members 101M, 101C, 101Y, and 101K which form four colors.

When conducting a black monochrome printing, the transfer belt 150 maintains a contact only with the photo-conductive member 101K.

The transfer bias applying member 167K and the adjacent back-up roller 168 are provided to an exit bracket 198. The exit bracket 198 can pivot at a shaft 199, which is coaxial with an exit roller 162.

When detaching the transfer unit 106 from the body D3, the transfer unit 106 is rotated in a clockwise direction by operating a handle (not shown). Then, the transfer bias applying member 167K and the adjacent back-up roller 168 is moved away from the photo-conductive member 111K.

A cleaning device 185 in FIG. 9 having a brush roller and a cleaning blade is arranged so that it contacts an outer surface of the transfer belt 150 extended to the drive roller 163. The cleaning device 185 removes foreign materials such as toner adhered on the transfer belt 150.

The support roller 164 is provided downstream of the drive roller 163 with respect to the traveling direction of the transfer belt 150. The support roller 164 pushes an outer surface of the transfer belt 150, and secures an appropriate extending angle of the transfer belt 150 to the drive roller 163.

Furthermore, a tension roller 165 (support roller 165) having a spring 169 is provided downstream of the support roller 164 with respect to the traveling direction of the transfer belt 150. The tension roller 165 contacts a back surface of the transfer belt 150, and gives a tension to the transfer belt 150 using the spring 169 as a pressure member.

In FIG. 9, a chain line shows a transport route of the recording sheet 200. The recording sheet 200 is fed from the sheet feeding cassettes 103 and 104 or the manual feed tray MF, and is transported to a temporary stopping position, where a pair of registration rollers 105 is provided, through a transport guide (not shown) by a transport roller.

The recording sheet 200 fed by the pair of registration rollers 105 at a predetermined timing is carried on the transfer belt 150 to be transported to the image forming units 101M, 101C, 101Y, and 101K, and passes through the transfer nips.

Each of the toner images is developed on each of the photo-conductive members 111M, 111C, 111Y, and 111K of each of the image forming units 101M, 101C, 101Y, and 101K.

Then, each of the toner images is transferred and overlayed on the recording sheet 200 at each of the transfer nips by an action of a transfer electric field and a nip pressure. With such an overlaying transfer procedure, full color toner images are formed on the recording sheet 200.

After transferring toner images, surfaces of the photo-conductive members 111M, 111C, 111Y, and 111K are cleaned by cleaning devices, and are electrically discharged to prepare for a next image formation of an electrostatic latent image.

The recording sheet 200 having full color toner images thereon is fed to the fixing device 107 to fix the full color toner images on the recording sheet 200. Then the recording sheet 200 is sent in a first sheet ejection direction B or a second sheet ejection direction C corresponding to a rotation direction of a pawl G.

When the recording sheet 200 is ejected to a first sheet ejection direction B, the recording sheets 200 are stacked on the sheet ejection tray 108 with a face-down condition, in which printed images are facing downward.

On one hand, when the recording sheet 200 is ejected to a second sheet ejection direction C, the recording sheet 200 is transported to a post-processing device (not shown) such as a sorter and a stitching or stapling device, or to the pair of registration rollers 105 again after passing through a switch-back portion (not shown) for double sided printing.

The transfer unit 106 is affected by the heat generated from the fixing device 107 arranged adjacent to the exit roller 162.

The heat of the fixing device 107 inevitably affects the exit roller 162 at a maximum level because the exit roller 162 is the closest to the fixing device 107.

Hereinafter, experiments conducted by the present inventors on a relationship between the temperature change of the transfer belt 150 and the belt elongation of the transfer belt 150 will be explained.

Figure 11:
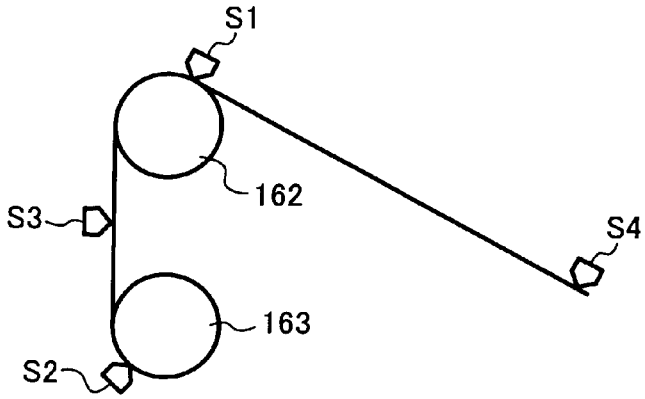
FIG. 11 is an exemplary partial cross sectional view of the transfer unit in FIG. 9 explaining positions of temperature sensors.

A solid metal roller is used for the exit roller 162 for experiments. Four temperature sensors S1, S2, S3, and S4 are placed at the following positions in the transfer unit 106 as illustrated in FIG. 11: S1 at the exit roller 162; S2 at the drive roller 163; S3 between the exit roller 162 and the drive roller 163; and S4 between the image forming unit 101C and image forming unit 101Y.

Figure 12:
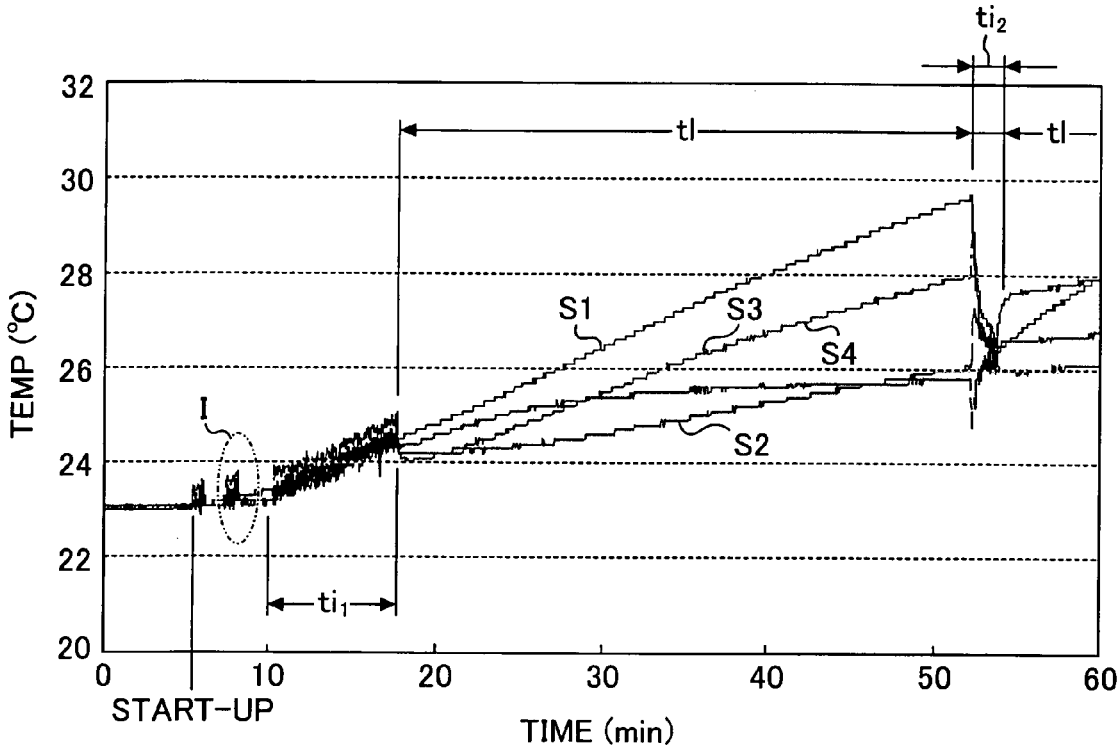
FIG. 12 is an exemplary graph showing temperature changes in each part of the transfer unit in FIG. 9.

Temperature sensors S1, S2, S3, and S4 indicate temperature changes as shown in the graph of FIG. 12.

The vertical axis represents the temperature and the horizontal axis represents the time (minute) in FIG. 12. As shown in the graph, the image forming apparatus conducts a following operation, for example.

After the start-up of the image forming apparatus, an initialization process I is conducted for each part of the image forming apparatus.

Then, the transfer belt 150 transports recording sheets (1 to 100 sheets, for example) for image formation.

After the image formation of 100 sheets, for example, the image forming apparatus is left for a leaving time tl (about 30 minutes, for example) before resuming the sheet transportation of a predetermined number (20 sheets, for example) for image formation.

The trend of temperature changes detected by the temperature sensors S1, S2, S3, and S4 is shown in FIG. 12.

After leaving the image forming apparatus for the time leaving tl (about 30 minutes, for example), an image formation is resumed.

At this time, the level of temperature at each part of the transfer unit 106 is not uniform as shown in a time $ti_2$ in FIG. 12. Similar phenomena occur more or less regardless of the leaving time tl of the image forming apparatus.

After the initial start-up of the image forming apparatus, the transfer belt 150 continuously travels. Therefore, the temperature distribution along the circumference length of the transfer belt 150 is substantially uniform, thus the temperature change for each part is uniform (refer to the time $ti_1$ in FIG. 12).

However, when the transfer belt 150 is stopped and left after the initial image formation, the temperature at the exit roller 162 side (at temperature sensors S1 and S3) increases significantly. When an image formation is resumed under such a condition, temperature at each part does not change uniformly.

Accordingly, some part of the transfer belt 150 elongates in a different level compared to another part. This also means that the image transfer starting position of the transfer belt 150 is changed by such elongation, and a color displacement occurs by a transfer position displacement.

Figure 13:
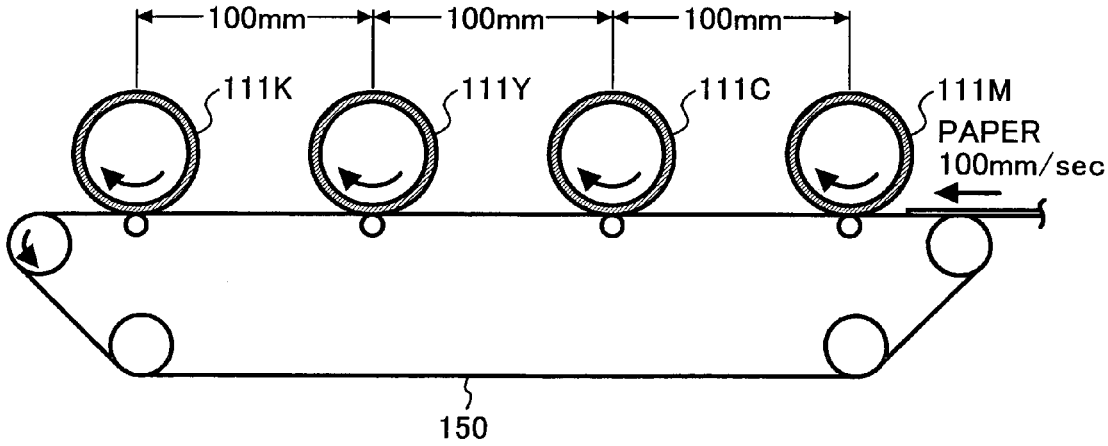
FIG. 13 is an exemplary schematic view of image forming mechanisms for explaining a color displacement.
Figure 14A:
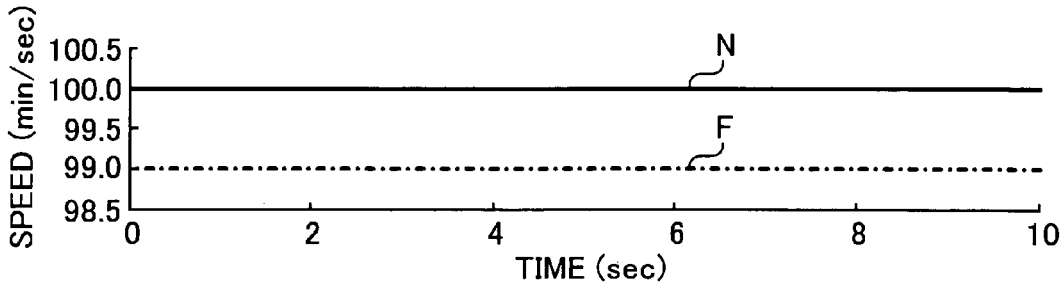
FIGS. 14A, 14B, and 14C are exemplary graphs for explaining the color displacement.

FIGS. 13, 14, and 15 are schematic mechanism of a color displacement in image forming portions using a tandem type.

In FIG. 13, each of the photo-conductive members 111M, 111C, 111Y, and 111K is arranged with a same transfer pitch distance (for example, 100 mm) along one side of the transfer belt 150, and a traveling speed of the recording sheet is set to 100 mm/sec, for example.

Under such a condition, a writing to the photo-conductive member 111M for magenta is conducted at first, and one second later, a writing to the photo-conductive member 111C for cyan is conducted.

Similarly, a writing to the photo-conductive member 111Y for yellow is conducted two seconds later, and a writing to the photo-conductive member 111K for black is conducted three seconds later of the writing to the photo-conductive member 111M for magenta.

When the transfer belt 150 has no partial elongation and travels normally at a constant speed (standard speed), a color displacement does not occur because toner images of each color are correctly overlayed on the recording sheet from each of the photo-conductive members.

Figure 14B:
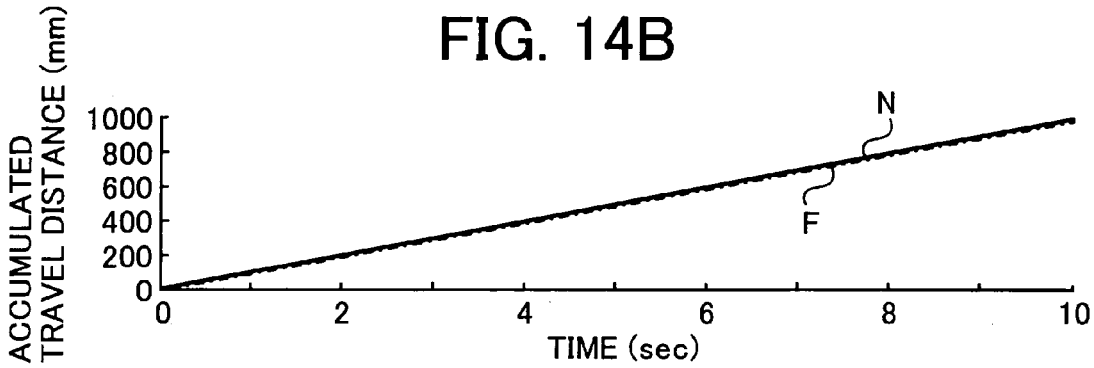

However, when a traveling speed becomes 99 mm/sec (a chain line F in FIG. 14A) from the standard speed of 100 mm/sec (a solid line N in FIG. 14A) by a partial elongation of the belt, the accumulated travel distance of the transfer belt 150 decreases as indicated by a chain line F in FIG. 14B.

In FIG. 14B, the difference between the standard speed (the solid line N in FIG. 14B) and the decreased speed (the chain line F in FIG. 14B) looks small, but the difference is clearly identified when the scale unit of the vertical axis is enlarged. Consequently, a positional deviation becomes larger as the time passes as shown in FIG. 14C.

Figure 14C:
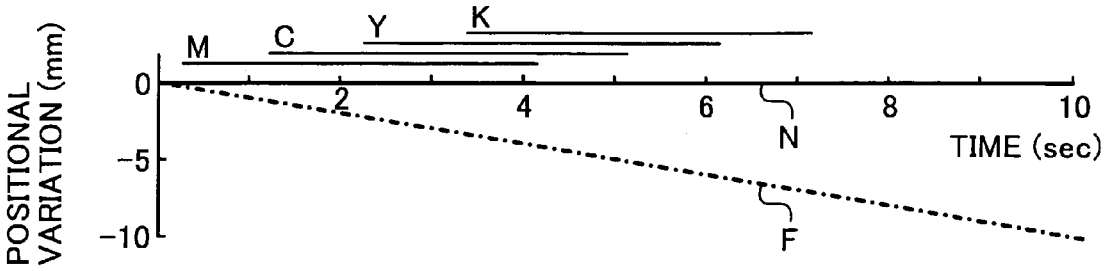

In FIG. 14C, an operation of the magenta image formation is started from after the start-up of the image forming apparatus to about four seconds, an operation of the cyan image formation is started from after one second to about five seconds, an operation of the yellow image formation is started from after two seconds to about six seconds, and an operation of the black image formation is started from after three seconds to about seven seconds, for example.

Figure 15A:
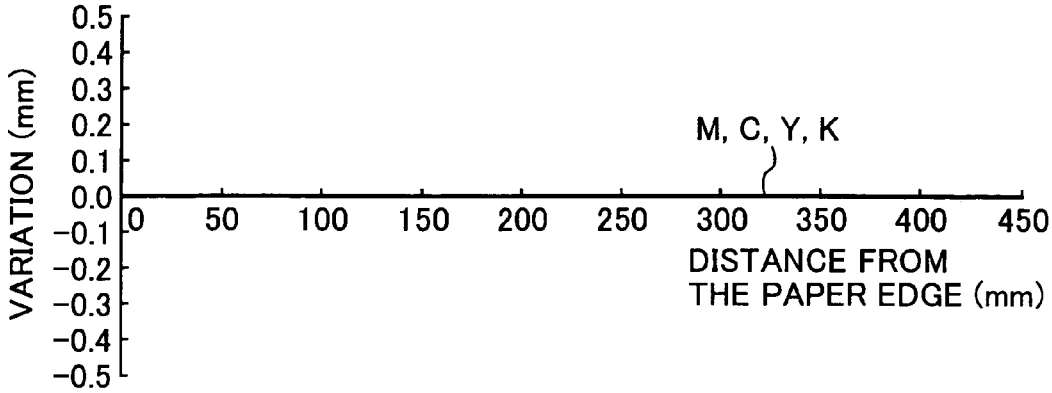
FIGS. 15A, 15B, and 15C are another exemplary graphs for also explaining the color displacement.

When the transfer belt 150 has no partial elongation, there are no variations of the distance of each of the toner images from an edge of the recording sheet, and the toner images correctly overlayed on the recording sheet. Therefore, a color displacement does not occur as shown in FIG. 15A.

Figure 15B:
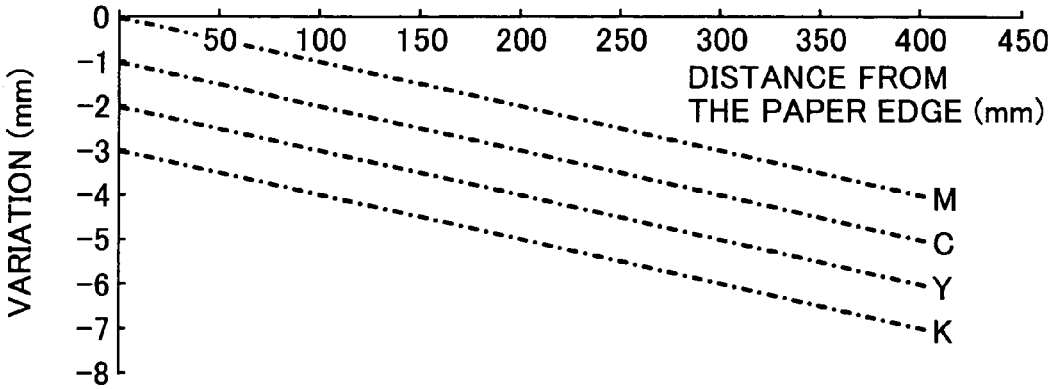
Figure 15C:
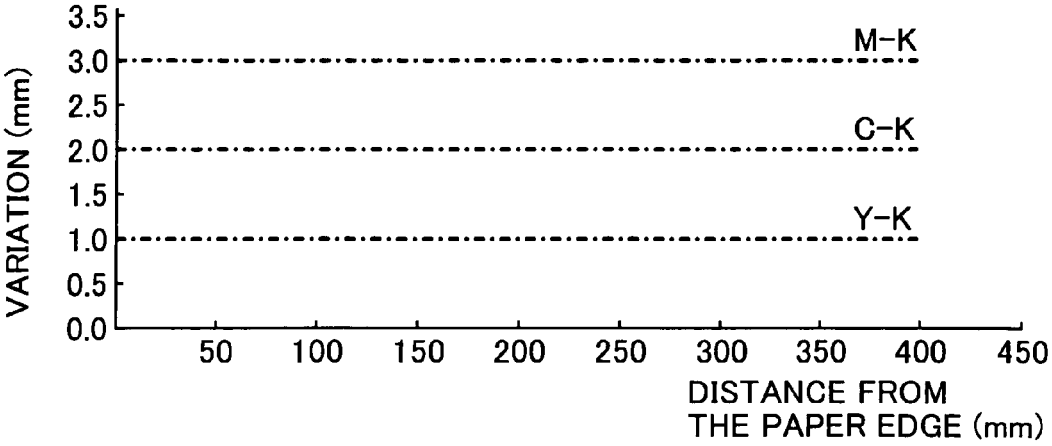

On the other hand, when the belt has some partial elongation, variations in the distance of each of the toner images from an edge of the recording sheet occurs as shown in FIG. 15B, and positional deviations of magenta, cyan, and yellow occur with respect to black as shown in FIG. 15C.

Under such a condition, a color displacement occurs when each of the toner images are overlayed.

As discussed above, a color displacement occurs when an image formation (or sheet feed) is resumed after leaving the image forming apparatus for some time. The level of the color displacement depends on a temperature increase amount at the exit roller.

In case of a transfer belt having a similar configuration as in the present invention, a color displacement of about 100 μm occurs after leaving an image forming apparatus for about 30 minutes, for example.

To cope with such a situation, an image forming apparatus according to an exemplary embodiment of the present invention employs a feedback control, in which the traveling speed of the transfer belt 150 is detected to compare with a target speed (standard speed) for computing a speed difference, and the traveling speed of the transfer belt 150 is adjusted to the target speed.

To conduct a feedback control, detection positions for the traveling speed of the transfer belt 150 are placed to the area in which the transfer belt 150 is almost free of the temperature change. With such a configuration, the precision of the feedback control can be improved.

Consequently, a color displacement in an image forming apparatus can be effectively prevented.

To conduct the feedback control, a detection roller is provided. As explained later, an encoder 120 is provided to the detection roller. The detection roller is used as a component of a detecting mechanism to detect a traveling speed of the transfer belt 150, and made of a material of low heat expansion, and shaped to be low moment of inertia.

By doing so, a high feedback control performance is obtained and a stable traveling speed can be maintained for a long time. Accordingly, an image effectively reducing a color displacement can be provided for a long time.

Hereinafter, the feedback control of the transfer belt 150 of an image forming apparatus according to another exemplary embodiment will be explained.

Figure 16:
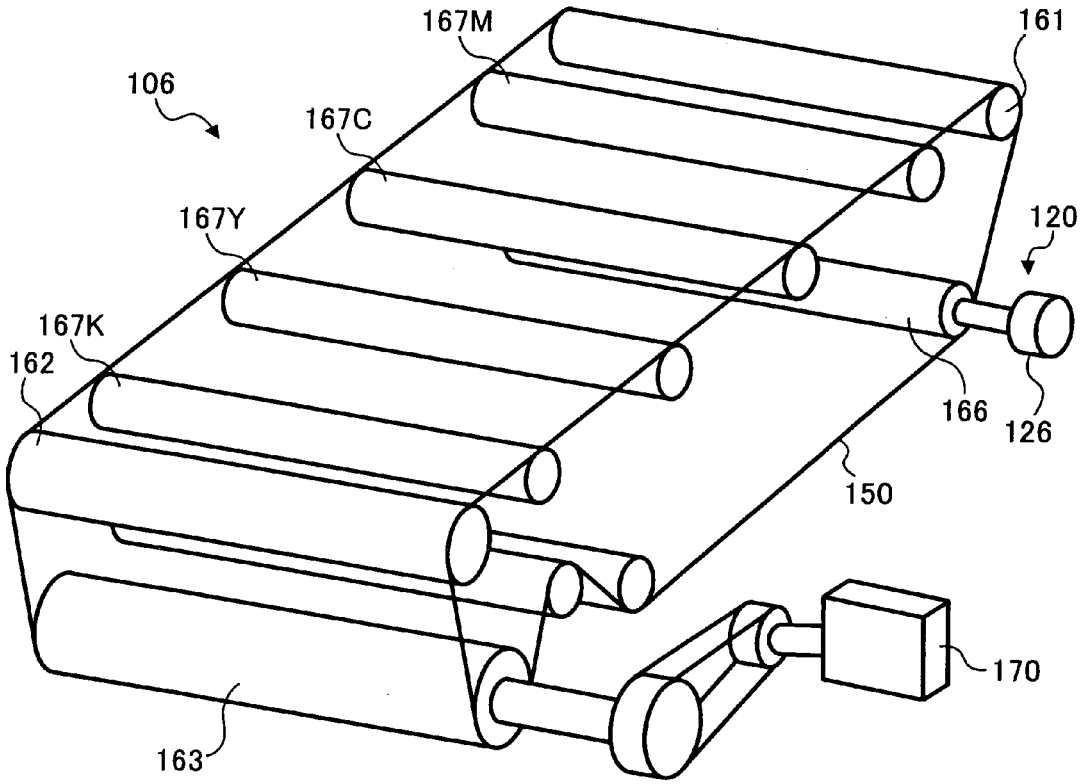
FIG. 16 is an exemplary schematic view of the transfer unit in FIG. 9 for explaining an installment position of an encoder.

As illustrated in FIG. 16, in the image forming apparatus according to another exemplary embodiment, the transfer belt 150 in the transfer unit 106 is extended to a plurality of support rollers.

An encoder 120 is provided to a lower-right roller 166, one of the support rollers, to detect a traveling speed of the transfer belt 150.

The lower-right roller 166 is disposed at a remote position from the fixing device 107, a heat source that generates a large amount of heat in the image forming apparatus.

Therefore, the lower-right roller 166 is disposed at the position in which the transfer belt 150 is not susceptible to heat.

Other than the fixing device 107, a large amount of heat is also generated in the image forming apparatus by another heat source, which is the optical writing unit 102.

Because the lower-right roller 166 is also disposed at a remote position from the optical writing unit 102, the lower-right roller 166 is rarely affected by the optical writing unit 102.

Therefore, the lower-right roller 166 is disposed at the position in which the transfer belt is not susceptible to heat.

Accordingly, a temperature increase of the lower-right roller 166 is small during a normal operation of the image forming apparatus.

However, the speed of the transfer belt 150 may increase due to the temperature increase of the lower-right roller 166 when a continuous printing is conducted for a long time.

Figure 17:
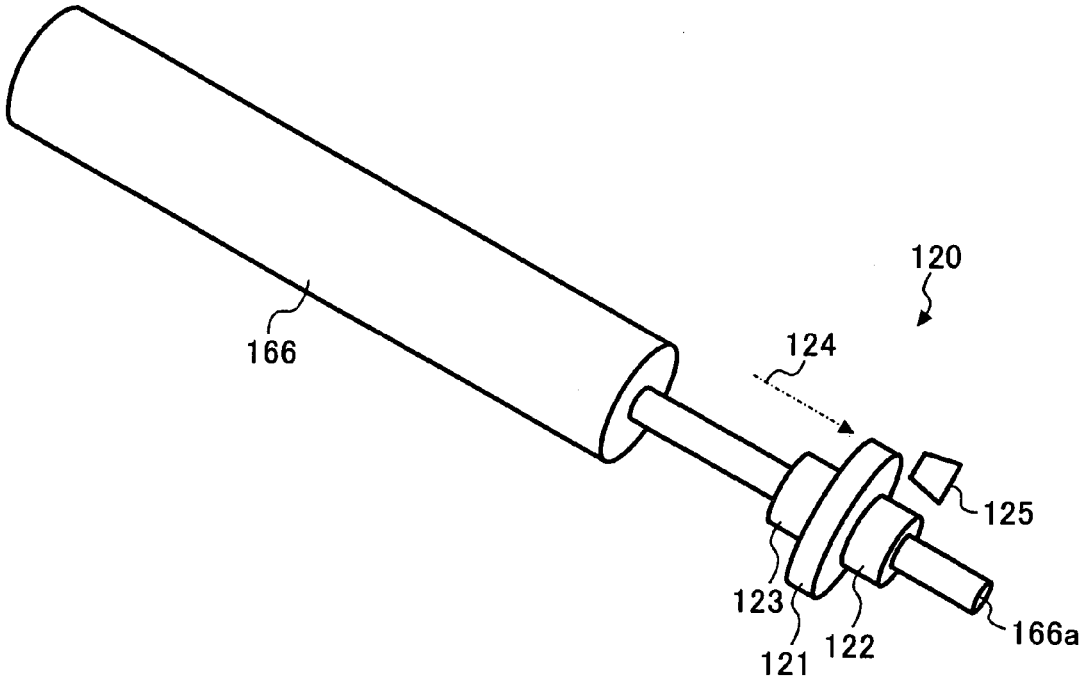
FIG. 17 is an exemplary partial cross sectional view of the encoder in FIG. 16 explaining its components.

As illustrated in FIG. 17, the encoder 120 includes a slit disk 121*a*, press fit bushes 122 and 123, a light-emitting element 124, and a light-receiving element 125.

The slit disk 121 is fitted and fixed to a shaft 166*a* of the lower-right roller 166 with the press fit bushes 122 and 123. The light-emitting element 124 and the light-receiving element 125 are arranged to sandwich the slit disk 121.

The slit disk 121 has a number of slits (not shown) with a same angular pitch. A light emitted from the light-emitting element 124 passes through the slit, and the light is received at the light-receiving element 125.

The rotation speed of the lower-right roller 166 is detected based on the number of pulses output by the light-receiving element 125 per unit time, and subsequently the speed of the transfer belt 150 is computed.

In the image forming apparatus according to another exemplary embodiment of the present invention, components of the encoder 120 are enclosed in a case 126 as illustrated in FIG. 16 to be protected from heat, dust or the like.

The roller provided with the encoder 120 is not restricted to the lower-right roller 166, and the entrance roller 161 may be provided with the encoder 120.

However, the entrance roller 161 is configured to be movable as described above so that the entrance roller 161 is not suitable to be provided with the encoder 120. Therefore, the encoder 120 is favorably provided to the lower-right roller 166, which is a fixed roller.

Hereinafter, the feedback control for the image forming apparatus according to another exemplary embodiment of the present invention is briefly explained.

An output signal of the encoder 120 is input to a controller (not shown) such as a control device controlling an image forming apparatus.

Based on the output signal of the encoder 120, a drive motor 170 (refer to FIG. 16) is controlled, and the drive motor 170 drives the drive roller 163 to make the traveling speed of the transfer belt 150 to a target speed.

In addition, an explanation is described for an increase of the traveling speed of the transfer belt 150 when the temperature increase occurs to the above-described lower-right roller 166.

When the encoder 120 is used for the feedback control, an output signal of the encoder 120 is used to stabilize the rotation speed of the lower-right roller 166. And the pulse of the drive motor 170 is adjusted to stabilize the traveling speed of the transfer belt 150.

When the rotation speed is represented by $\omega$, the traveling speed of the transfer belt by v, and the radius of the detection roller (i.e. the lower-right roller 166) by r, the equation $\omega=v/r$ is established.

Under such a relationship, when the radius r of the detection roller is expanded by heat, the traveling speed of the transfer belt v is increased to maintain the rotation speed $\omega$ at a stable level.

Accordingly, careful consideration is given to the material and shape of the detection roller in the image forming apparatus according to another exemplary embodiment of the present invention to minimize the heat expansion of the detection roller.

To reduce an influence by the heat expansion, following considerations are required: choose a material having low linear expansion coefficient; and increase a work (Joule) required to raise the temperature by one degree, calculated from the specific heat, density, and used amount of the material of the detection roller.

If a high density material is used in large scale, it is a very effective countermeasure for heat expansion in general. However, when the high density material is used for the detection roller, a moment of inertia increases unfavorably so that the detection roller cannot keep up with a minute variation in the traveling speed of the transfer belt.

Therefore, reducing the influence of the heat expansion as low as possible, and suppressing the moment of inertia as low as possible are required to realize a stable traveling speed of the transfer belt for a long time.

FIGS. 22A and 22B show how the "work (Joule) required to raise the temperature by one degree" and the moment of inertia changes when the material and thickness is changed for the detection roller 166.

According to FIGS. 22A and 22B, a material of INVAR (low heat expansion alloy) has the lowest outer diameter expansion coefficient among the materials, however, the material to be used is selected by reviewing a cost performance of each material and a required performance of the image forming apparatus.

Reducing the heat expansion of the detection roller is effective to suppress the color displacement. To reduce the heat expansion of the detection roller, a material for the detection roller is selected considering the following criteria: a diameter expansion rate against temperature; a work (Joule) required to raise the temperature by one Celsius degree; and a linear expansion coefficient.

Specifically, a material having a diameter expansion rate of 0.05% or less, a work required to raise the temperature by one Celsius degree being 30 Joule or more, and a linear expansion coefficient of $25\times10^{-6}$ (1/° C.) or less, was effective to suppress the color displacement. Such materials may be aluminum, iron, stainless, INVAR, carbon fiber, or the like.

A diameter expansion rate of 0.05% or less is based on data of FIGS. 22A and 22B. Similarly, a work required to raise the temperature by one Celsius degree being 30 Joule or more, and a linear expansion coefficient of $25\times10^{-6}$ (1/° C.) or less is deducted from FIGS. 22A and 22B.

Figure 18A:
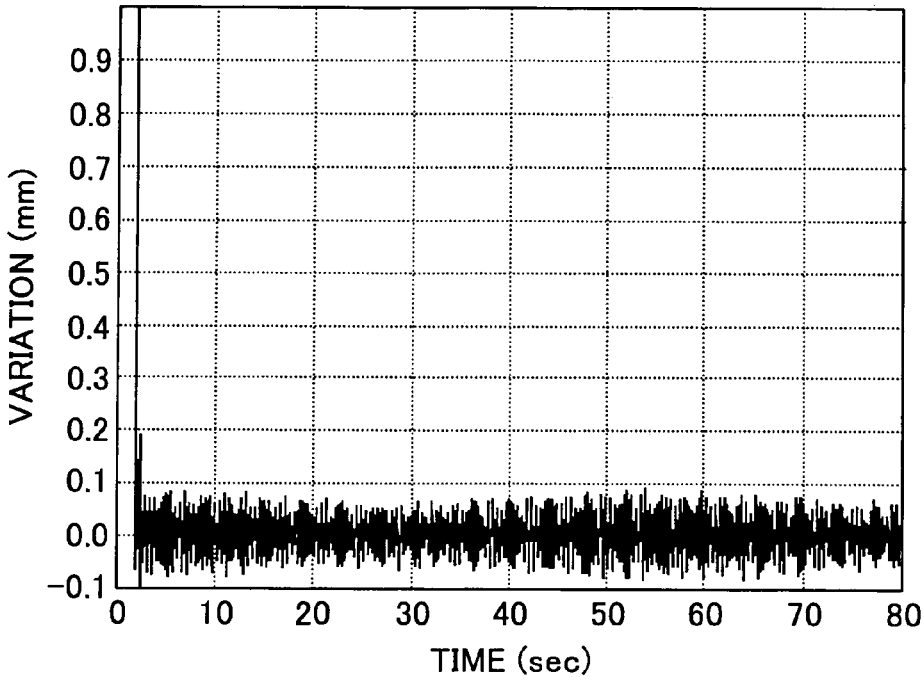
FIG. 18A is an exemplary graph showing a variation of a traveling speed when the encoder conducts a feedback control.
Figure 18B:
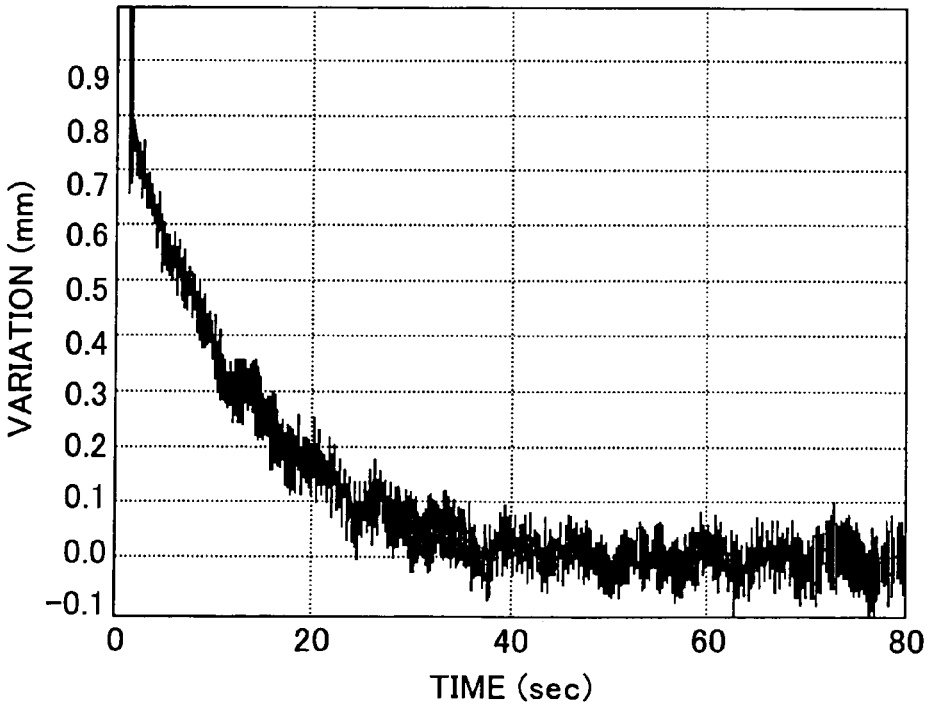
FIG. 18B is an exemplary graph showing a variation of a traveling speed when the feedback control is not conducted.
Figure 18C:
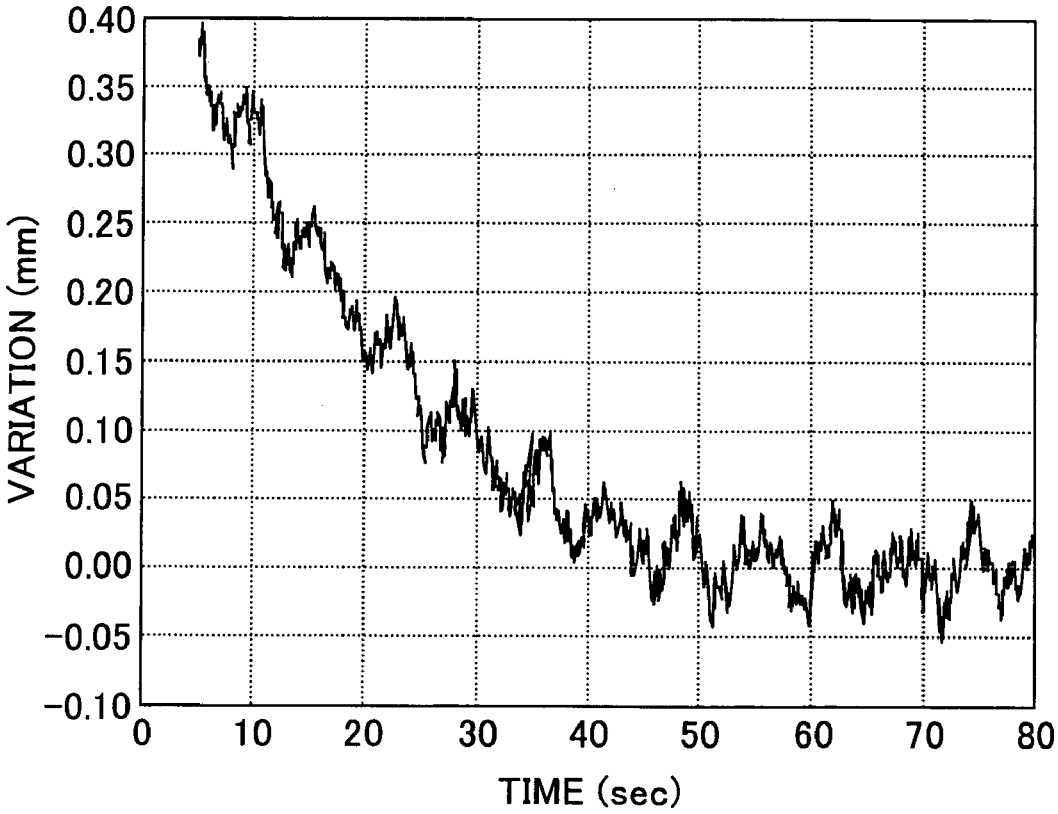
FIG. 18C is an exemplary graph showing a variation of a traveling speed when a feedback control is conducted by providing an encoder to a position different from the case in FIG. 18A.

FIGS. 18A, 18B, and 18C are graphs showing variations of the traveling speed of the transfer belt 150. The vertical axis represents the variation of the traveling speed and horizontal axis represents the time. The traveling speed is computed by integrating outputs of the encoder 120.

In FIG. 18A, a feedback control is conducted by the encoder 120 provided to the lower-right roller 166.

In FIG. 18B, a feedback control is not conducted.

In FIG. 18C, a feedback control is conducted by an encoder provided to the exit roller 162.

As shown in FIG. 18A, the variation of the traveling speed is extremely stable right after the start-up of the image forming apparatus, or the start-up of the rotation of the transfer belt 150. Therefore, a color displacement does not occur.

Compared to FIG. 18A, the variation of the traveling speed in FIG. 18B is large for about 40 seconds right after the start-up of the image forming apparatus. Therefore, a color displacement may occur. However, the variation of the traveling speed decreases as the time passes and becomes stable after the time of 40 seconds.

Compared to FIG. 18B, a variation of the traveling speed in FIG. 18C is smaller than that of FIG. 18B having no feedback control, but the variation of the traveling speed is large for about 40 seconds right after the start-up of the image forming apparatus. However, similarly to FIG. 18B, the variation of the traveling speed in FIG. 18C decreases as the time passes and becomes stable after the time of 40 seconds.

As described above, the present invention provides a sensor to detect the traveling speed of the transfer belt at a position unsusceptible to the heat source, and the sensor conducts a feedback control. Specifically, at such a position, temperature change of the transfer belt rarely occurs.

Therefore, the present invention can improve the precision of the feedback control, and effectively prevent a color displacement in the image forming apparatus of tandem type.

The detection roller is made of a material and shape considering thickness, which is hard to be affected by the heat in a case that the detection roller accumulates some heat.

By such a selection, an increase of the traveling speed of the transfer belt caused by the heat expansion of the detection roller can be suppressed during the feedback controls and a color displacement in the image forming apparatus of tandem type can be effectively prevented.

Furthermore, a variety of the material and shape considering thickness can be used to realize a lower cost, a high precision of vibration detection, and a lower moment of inertia, which are selectively used for different purposes of machines.

In general, an image forming apparatus of tandem type can form a full color image in a short time similarly as a monochrome image, and preferable for a high speed printing.

However, it has some problems for high image quality, and particularly, it is difficult to prevent a color displacement.

The present invention provides an image forming apparatus that can realize a high speed printing and a color displacement prevention at the same time, and can obtain a full color image with a high image quality in a short time by conducting a precise feedback control for the transfer belt 150.

The feedback control for the transfer belt according to an exemplary embodiment is also applicable to a monochrome image forming apparatus, but the feedback control exerts very effectively to prevent a color displacement in an image forming apparatus of tandem type as described above.

Figure 19:
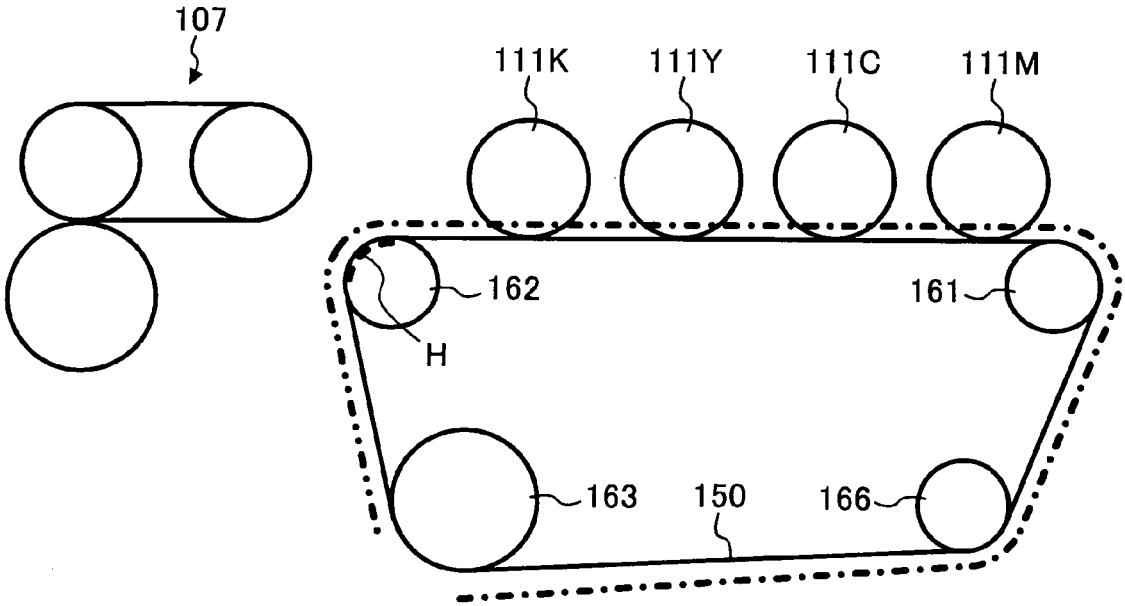
FIG. 19 is an exemplary schematic illustration for explaining precision levels of a feedback control depending on different positions of encoders.

FIG. 19 is an exemplary schematic view explaining precision levels of the feedback control depending on different positions of encoders.

As for the image forming apparatus of FIG. 9, the exit roller 162 is warmed by the fixing device 107, and the heat is transmitted to the transfer belt 150 at a position H illustrated in FIG. 19. The heat changes the elongation of the transfer belt 150 partially.

The variation amount of the elongation differs depending on tensions occurred in image forming process, and an area indicated by a chain line elongates larger than an area indicated by two-dot chain line.

At an area contacting the drive roller 163, the transfer belt 150 travels at a predetermined speed (standard speed) regulated by the drive roller 163.

The exit roller 162 is driven at a speed slower than the standard speed a little due to the elongation of the transfer belt in the area indicated by the two-dot chain line.

Because the area indicated by a chain line elongates larger than the area indicated by a two-dot chain line, the area of a chain line is driven at a speed slower than the speed at the exit roller 162.

An area that influences an image formation of the toner images is an area facing the photo-conductive members 111M, 111C, 111Y, and 111K, which is indicated by the chain line.

Thus, even if the feedback control is conducted by detecting the traveling speed at the exit roller 162 rotated by a speed, regulated by the area indicated by the two-dot chain line, an amount of the feedback is not enough to correct the traveling speed of the transfer belt 150 to the target speed.

FIG. 18C shows such a situation that the variations of the speed becomes larger, and the speed is slower than the target speed for about 40 seconds right after the start-up of the transfer belt.

On the other hand, the rotation speed of the lower-right roller 166 is regulated by an area indicated by the chain line, which is the area affecting the image formation.

The feedback control is conducted based on the traveling speed detected at the lower-right roller 166 so that the traveling speed at the lower-right roller 166 becomes the target speed.

Therefore, an area affecting the image formation also becomes the target speed, and the variations of the speed is reduced right after the start-up of the transfer belt as shown in FIG. 18A. Thus, a color displacement can be prevented.

When an encoder is used to detect a traveling speed of the transfer belt, a slit disk (refer to the slit disk 121 in FIG. 17) should be fixed to a shaft (the shaft 166*a* of the lower-right roller 166) with extremely high precision. However, the slit disk cannot be fixed with zero eccentricity. Therefore, an error by the eccentricity should be considered.

Thus, in an image forming apparatus according to another exemplary embodiment, a transfer pitch distance of the adjacent photo-conductive members 111M, 111C, 111Y, and the 111K of the image forming unit (hereinafter, referred as photo-conductive member pitch) is set to a length gained by multiplying a circumference length of the lower-right roller 166 with substantially a positive integer.

That is, an error caused by an eccentricity of the slit disk is detected as the variation in traveling speed of the transfer belt 150, and a reverse phase of such a detection result is feedbacked, and the transfer belt 150 is driven.

Therefore, some measures are required to prevent a color displacement even if the variation of the traveling speed occurs by the above-mentioned reverse phase.

Similarly, the vibration of the detection roller itself causes a color displacement.

Therefore, a ratio of the circumference length of the lower-right roller 166 and the photo-conductive member pitch is set to substantially a positive integer.

In another exemplary embodiment, the circumference length of the lower-right roller 166 is set to one half of the photo-conductive member pitch. When the shaft provided with the encoder 120 rotates two times, or the transfer belt 150 travels a distance of two rotations of the shaft, the recording sheet comes to a position in which a toner image is transferred from the next photo-conductive member.

Therefore, a same phase cycle of variations in speed of the transfer belt 150 caused by the eccentricity of the assembled slit disk comes to the each position of the photo-conductive members. Thus, a positional displacement (not a color displacement) of each color image becomes the same. Consequently, a color displacement does not occur.

The ratio of the circumference length of the roller and the photo-conductive member pitch is not restricted to 1:2 of the above exemplary embodiment, and another ratio is allowed as long as the ratio keeps 1:x relationship, wherein the x is a positive integer.

As for the vibration of the detection roller itself, the precision of the vibration can be improved by a manufacturing method, a selection of material and shape considering thickness.

Specifically, stainless steel or aluminum are likely to obtain a high precision compared to iron because a surface treatment can be omitted.

Furthermore, a deformation of the component can be prevented easily by thickening the thickness of the material.

However, a larger thickness increases a moment of inertia, and the feedback control performance decreases. Therefore, a balance between the deformation prevention and the feedback control performance should be considered.

To simplify the explanation, a term "circumference length of the roller" is used. More strictly, the term means a value gained by multiplying a value, calculated by adding a roller diameter and one half of thickness of the transfer belt, and the Ludolphian number (pi).

A "substantially positive integer ratio" is in a range of allowance allocated for the manufacturing process, and such an allowance does not constitute a problem because it is not perceivable by human eyes.

Hereinafter, a relationship between the elongation of the belt and the color displacement will be explained with an assumption that all of the elongation of the belt affects the color displacement. For example, a color displacement of magenta with respect to black will be explained.

The distance between a magenta photo-conductive member (M) and the black photo-conductive member (K) is set to 294 mm, for example, the roller diameter (2r) to 31.2 mm, for example, the belt thickness (t) to 0.2 mm, for example.

Then, by a formula, $(2r+t/2)\times\pi=(31.2+0.1)\times3.14$, 31.3 mm×3.14=98.28 mm is gained.

The "roller diameter+one half of transfer belt thickness" is 3.1.3 mm in a case of a standard speed when the transfer belt has no elongation, and thus, the standard speed=125.3117 mm/sec, and the M and K have a difference of writing timing of 2.346149641 sec. At this time, the rotation speed of the drive roller is 76.4625 rpm (rotation per minute).

Next, assume that the heat elongates the transfer belt and the thickness of the transfer belt becomes 0.158 mm. Because one half thickness of the transfer belt is 0.079 mm in this case, "roller diameter+one half thickness of the transfer belt" becomes 31.279 mm.

At this time, the traveling speed of the transfer belt becomes 125.2264539 mm/sec, and its ratio against the standard speed lowers by 0.068%.

If all of the reduced speed affects a color displacement, the elongation rate of the transfer belt also becomes 0.068%, and a color displacement occurs by an amount gained by calculating "M to K distance 294 mm×0.068%=0.19992 mm", that is about 200 μm.

Next, the variation of the traveling speed of the transfer belt when a diameter of the detection roller changes will be explained.

When a diameter Φ of the detection roller increases from 15.5 mm to 15.51054 mm (0.068% increase), the traveling speed of the transfer belt also increases by 0.068%.

Therefore, a color displacement occurs by an amount gained by calculating "M to K distance 294 mm"×0.068%=0.19992 mm, that is about 200 μm.

However, 200 μm for the above-mentioned belt elongation and 200 μm for the detection roller expansion have different direction for the color displacement against the reference color.

As explained above, when the heat affects the transfer belt to elongate partially, the traveling speed of the transfer belt decreases and the color displacement occurs.

However, the present invention can effectively prevent the occurrence of the color displacement by conducting the feedback control of the transfer belt by detecting the traveling speed of the transfer belt.

Furthermore, the present invention can prevent the color displacement caused by an error occurred to the detection of the traveling speed due to an eccentricity error of an encoder disk by setting the ratio of the circumference length of the roller and the photo-conductive member pitch in a 1:x relationship, wherein the x is substantially a positive integer.

An embodiment of the present invention uses encoder to detect the traveling speed of the transfer belt 150. Components of the encoder can be sealed in a case having a simple construction to prevent influences by toner, dust or the like.

Furthermore, the high precision adjustment can be easily conducted and maintained for the encoder because a sensing part of the encoder can be adjusted independently. That is, the encoder can easily realize a high durability and a high precision without conducting complex procedures.

As for the sensor for the transfer belt 150, any configurations other than the encoder can be employed. For example, a predetermined reference scale can be provided on the transfer belt 150 to be read by laser beam or the like to detect a traveling speed of the transfer belt 150.

The occurrence of the color displacement can be prevented by conducting a feedback control by detecting a traveling speed with any methods including the above described method.

In an exemplary embodiment of the present invention, the encoder 120 is provided to the lower-right roller 166, at which the temperature change of the transfer belt rarely occurs. However, a roller to be provided with the encoder is not restricted to the lower-right roller 166.

For example, an encoder may be provided to the entrance roller 161, which is remote from the fixing device. However, the entrance roller 161 is movably provided as described above in an exemplary embodiment, thereby it is difficult to provide an encoder to the entrance roller 161.

Therefore, among the rollers fixed to positions (that is, not movable), an encoder is provided to a roller which is the most remote from a heat source such as a fixing device, an optical writing device or the like.

In addition, a tension roller 165 is provided between the lower-right roller 166 and the drive roller 163 in an exemplary embodiment of the present invention, and gives a tension to the transfer belt 150.

With respect to the traveling direction of the transfer belt 150, the rollers 163, 165, 166 have a relative positional relationship that the tension roller 165 is disposed at a downstream of the drive roller 163, and the roller 166 is disposed at a downstream of the tension roller 165.

Under such a relative positional relationship, the tension roller 165 is provided between the lower-right roller 166 and the drive roller 163 to prevent slipping of the transfer belt 150 at the lower-right roller 166. Therefore, a more correct detection of the traveling speed of the transfer belt 150 can be realized.

Hereinafter, another exemplary embodiment of the present invention conducting a feedback control to an intermediate transfer belt will be explained.

Figure 20:
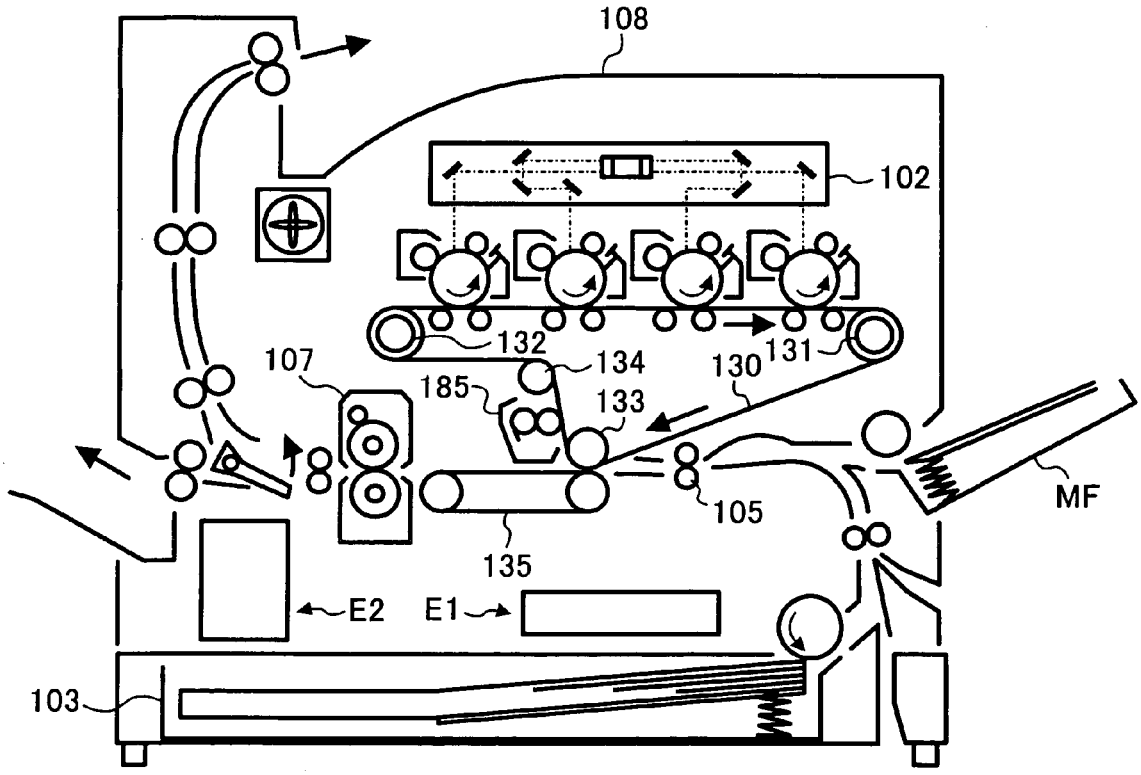
FIG. 20 is an exemplary schematic cross sectional view of an image forming apparatus according to another exemplary embodiment of the present invention, using an intermediate transfer method.

FIG. 20 is an exemplary schematic cross sectional view of an image forming apparatus of tandem type according to another exemplary embodiment of the present invention, using an intermediate transfer method.

The image forming apparatus of tandem type of FIG. 20 arranges four color image forming units along an upper side of an intermediate transfer belt 130.

The intermediate transfer belt 130 is extended to four rollers: a driven roller 131; a drive roller 132; an opposing roller 133; and a pushing roller 134.

Under the intermediate transfer belt 130, a transfer belt 135 is arranged while making contact with the intermediate transfer belt 130 at the opposing roller 133. A fixing device 107 is arranged next to the transfer belt 135.

As is illustrated in FIG. 20, the image forming apparatus has like reference numerals designating identical or corresponding parts illustrated in FIG. 9, thus the explanations for such parts are omitted, and only the differences with FIG. 9 will be explained hereinafter.

In the image forming apparatus according to another exemplary embodiment, using an intermediate transfer method, each color image is formed on a surface of each of photo-conductive members in a drum shape of each of image forming units, and is overlayingly transferred to the intermediate transfer belt 130 to form a full color image on the intermediate transfer belt 130.

The full color image is transferred to a surface of a recording sheet, fed from a sheet feeding cassette 103, at a transfer position in which the opposing roller 133 and the transfer belt 135 faces each other, and the recording sheet is transported to the fixing device 107 in which toner images are fixed.

After the fixing, the recording sheet can be ejected to a sheet ejection tray 108 provided on an upper side of the image forming apparatus or another sheet ejection tray provided to a lateral side of the image forming apparatus.

In another exemplary embodiment, the traveling speed of the intermediate transfer belt 130 is detected by a sensor (not shown), and a feedback control is conducted to control the traveling speed of the intermediate transfer belt 130 to a target speed.

Any configurations can be employed as a sensor for the intermediate transfer belt 130. In another exemplary embodiment, an encoder is provided to the driven roller 131, for example. The configurations and operations of the encoder are similar to the encoder in FIG. 9.

In another exemplary embodiment of the present invention, the fixing device 107 generates the largest amount of heat in the image forming apparatus.

The driven roller 131 provided with an encoder is disposed at the most remote position from the fixing device 107 with respect to other rollers to which the intermediate transfer belt 130 is extended, and is disposed at a position in which the temperature change of the intermediate transfer belt 130 rarely occurs.

Assume that an encoder is provided to a shaft of the drive roller 132 or to a shaft of the pushing roller 134. Because the drive roller 132 and the pushing roller 134 are located close to the fixing device 107, a feedback control cannot be conducted with high precision when the traveling speed of the intermediate transfer belt 130 is detected at the drive roller 132 and the pushing roller 134, and a feedback control is conducted based on such detection results. This is similar to the case of the exemplary embodiment of FIG. 9 when the traveling speed of the transfer belt 150 is detected at the exit roller 162.

When a detection roller is expanded by heat, similar phenomena as the above-described exemplary embodiment of FIG. 9 occurs.

However, also in another exemplary embodiment, a precision level of the feedback control can be improved, and consequently, a color displacement can be effectively prevented by taking following considerations: provide a sensor for an intermediate transfer belt to a position in which the heat of a fixing device does rarely affect, or a position in which the temperature change of the intermediate transfer belt rarely occurs, and conduct a feedback control; and make the detection roller of a material and shape considering thickness which is hard to be affected by heat in case of the detection roller accumulates some heat.

With these considerations, a color displacement in an image forming apparatus using an intermediate transfer method can be effectively prevented.

Any configurations other than the encoder can be employed as a sensor for the intermediate transfer belt. For example, a reference scale can be provided on the intermediate transfer belt 130 to be read by laser beam or the like to detect a traveling speed similarly as the above described exemplary embodiment of FIG. 9.

When an encoder is used as a sensor, a ratio of a circumference length of a roller (i.e. the driven roller 131 in FIG. 20), to which a slit disk is provided, and a photo-conductive member pitch is set to a 1:x, wherein the x is substantially a positive integer to prevent the color displacement. This is a similar case as the above described exemplary embodiment of FIG. 9.

The feedback control for the transfer belt according to another exemplary embodiment of FIG. 20 is also applicable to a monochrome image forming apparatus using the intermediate transfer method, but the feedback control exerts very effectively to prevent a color displacement in an image forming apparatus of tandem type using the intermediate transfer method as described above.

Hereinafter, another exemplary embodiment of the present invention conducting a feedback control of a photo-conductive member belt will be explained.

Figure 21:
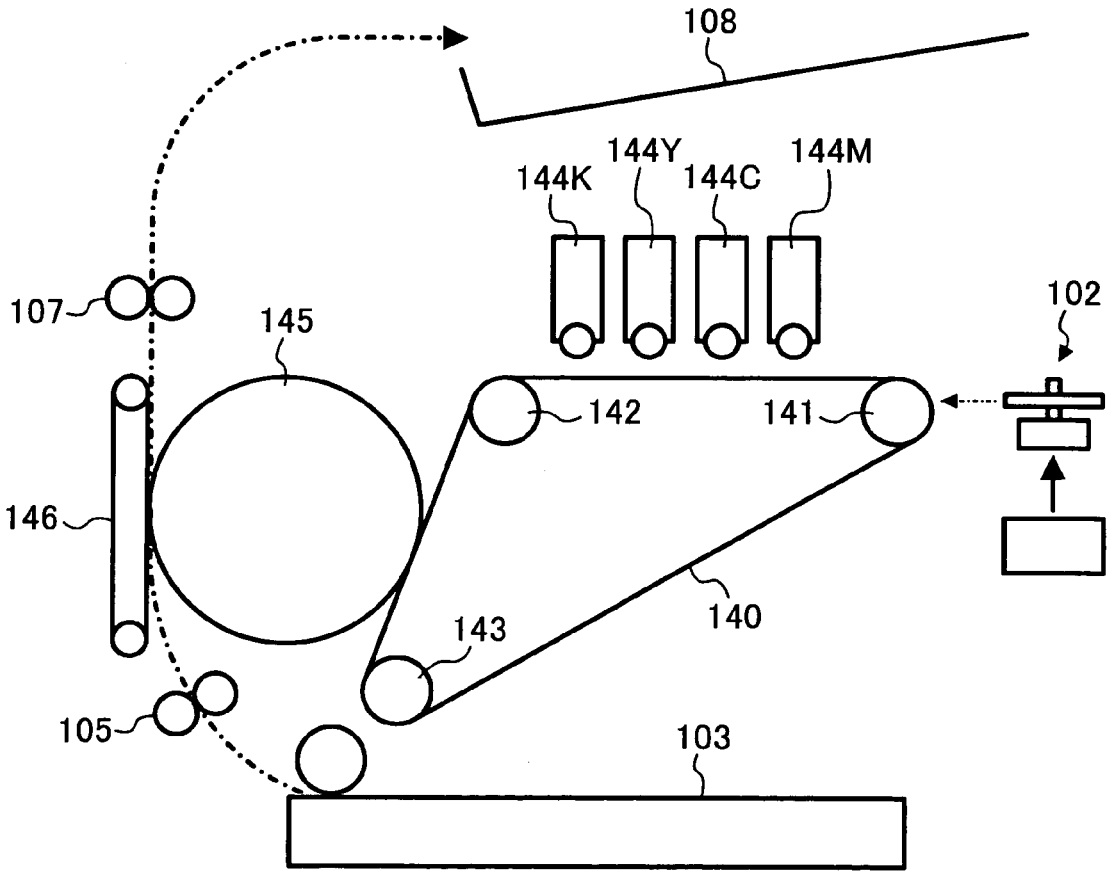
FIG. 21 is an exemplary schematic cross sectional view of an image forming apparatus according to another exemplary embodiment of the present invention, using a photo-conductive member belt.

FIG. 21 is an exemplary schematic cross sectional view of an image forming apparatus according to another exemplary embodiment of the present invention, using a photo-conductive member belt as an image carrying member.

The image forming apparatus of tandem type of FIG. 21 arranges four developing devices 144M, 144C, 144Y, and 144K in series along an upper side of a photo-conductive member belt 140.

The photo-conductive member belt 140 is extended to three rollers: a driven roller 141; an exit roller 142; and a drive roller 143.

To the left side of the photo-conductive member belt 140, an intermediate transfer drum 145 is arranged while making contact with the photo-conductive member belt 140.

Furthermore, to the left side of intermediate transfer drum 145, a transfer belt 146 is arranged while making contact with the intermediate transfer drum 145.

Furthermore, to the left side of intermediate transfer drum 145, a transfer belt 146 is arranged while making contact with the intermediate transfer drum 145.

Furthermore, a fixing device 107 is arranged above of the transfer belt 146.

As is illustrated in FIG. 21, the image forming apparatus has like reference numerals designating identical or corresponding parts illustrated in FIG. 9, thus the explanations for such parts are omitted, and only the differences with FIG. 9 will be explained hereinafter.

In the image forming apparatus according to another exemplary embodiment of FIG. 21, using an intermediate transfer method, an electrostatic latent image is formed on a surface of the photo-conductive member belt 140 corresponding to each of the color image information.

Then, toners are provided from each of developing devices 144M, 144C, 144Y, and 144K to visualize the electrostatic latent image of each color, and such images are overlayingly transferred to a surface of the intermediate transfer drum 145 sequentially to form a full color image on the surface of the intermediate transfer drum 145.

The full color image is transferred to a recording sheet, fed from a sheet feeding cassette 103, at a transfer position in which the intermediate transfer drum 145 and the transfer belt 146 face each other, and the recording sheet is transported to the fixing device 107 in which toner images are fixed.

After the fixing, the recording sheet is ejected to a sheet ejection tray 108 provided on an upper side of the image forming apparatus.

In another exemplary embodiment of FIG. 21, the traveling speed of the photo-conductive member belt 140 is detected by a sensor (not shown), and a feedback control is conducted to control the traveling speed of the photo-conductive member belt 140 to a target speed.

Any configurations can be employed as a sensor for the photo-conductive member belt 140. In another exemplary embodiment of FIG. 21, an encoder is provided to the driven roller 141, for example.

The configurations and operations of the encoder are similar to the encoder in FIG. 9.

In another embodiment of FIG. 21, the fixing device 107 generates the largest amount of heat in the image forming apparatus.

The driven roller 141 provided with an encoder is at the most remote position from the fixing device 107 with respect to other rollers to which the photo-conductive member belt 140 is extended, and is disposed at a position in which the temperature change of the photo-conductive member belt 140 rarely occurs.

Assume that an encoder is provided to a shaft of the exit roller 142. Because the exit roller 142 is disposed close to the fixing device 107, the feedback control cannot be conducted with high precision when the traveling speed of the photo-conductive member belt 140 is detected at the exit roller 142, and a feedback control is conducted based on such detection results.

This is similar to the case of the exemplary embodiment of FIG. 9, in which the traveling speed of the transfer belt 150 is detected at the exit roller 162.

However, also in another exemplary embodiment of FIG. 21, a precision level of the feedback control can be improved, and consequently, a color displacement can be effectively prevented by taking the following considerations: provide a sensor for a photo-conductive member belt 140 to a position in which the heat of a fixing device does rarely affect, or a position in which the temperature change of the photo-conductive member belt 140 rarely occurs, and conduct a feedback control; and make the detection roller of a material and shape considering thickness which is hard to be affected by heat in a case that the detection roller accumulates some heat.

With these considerations, a color displacement in an image forming apparatus using a photo-conductive member belt can be effectively prevented.

In another exemplary embodiment of FIG. 21, an encoder may be provided to the drive roller 143 which interposes the intermediate transfer drum 145 between the drive roller 143 and the fixing device 107. In such a case, the drive roller 143 is also remote from an optical writing device 102, and is less likely to be affected by the heat of the optical writing device 102.

Any configurations other than the encoder can be employed as a sensor for the intermediate transfer belt. For example, a reference scale can be provided on the intermediate transfer belt 130 to be read by laser beam or the like to detect a traveling speed as in the above described exemplary embodiment of FIG. 9.

Numerous additional modifications and variations are possible in light of the above teachings. It is therefore to be understood that within the scope of the appended claims, the disclosure of the present invention may be practiced otherwise than as specifically described herein.

For example, any configurations other than the encoder can be employed as a sensor for the transfer belt.

As for the method that transfers each of color images to a recording sheet directly from an image carrying member (photo-conductive member), which is described as an exemplary embodiment in FIG. 9, the transfer belt is not restricted to a movable type (at least a part of the transfer belt is movable with respect to the photo-conductive member), but a fixed transfer belt (always contacting the image carrying member) may be used.

In addition, a tandem type is not restricted to a four-color type, but other types using any number of colors including three-color type and two-color type can be employed.

Furthermore, any configurations can be employed for an optical writing device, a developing device, and a fixing device or the like in an image forming apparatus.

And an image forming apparatus can be employed for any apparatuses including a printer, a copying machine, or a facsimile.

Numerous additional modifications and variations are possible in light of the above teachings. It is therefore to be understood that within the scope of the appended claims, the disclosure of the present patent specification may be practiced otherwise than as specifically described herein.

This application claims priority from Japanese patent applications No. 2003-199451 filed on Jul. 18, 2003, No. 2003-290282 filed on Aug. 8, 2003, and No. 2004-136026 filed on Apr. 30, 2004 in the Japan Patent Office, the entire contents of which are hereby incorporated by reference herein.

What is claimed is:

1. An image forming apparatus, comprising:

at least one image carrying member configured to form a toner image on a surface thereof;

a transfer member having a surface facing the at least one image carrying member and configured to transfer the toner image to a recording medium;

a plurality of support rollers supporting the transfer member; and a detecting mechanism configured to detect a speed of the transfer member, comprising:

a detection roller including at least one support roller selected from the plurality of support rollers;

a roller shaft provided to the detection roller;

a moving member configured to rotate with the detection roller and directly fixed to the roller shaft;

a sensor configured to detect a moving speed of the detection roller with the moving member; and a controller configured to control a traveling speed of the transfer member to a target speed based on a detection result of the sensor, wherein a moment of inertia of the detection roller is substantially 35 ($kgf \cdot cm^2$) or less.

2. The image forming apparatus according to claim 1, wherein the transfer member includes an intermediate transfer belt configured to transfer the toner image to a recording medium.

3. The image forming apparatus according to claim 1, wherein the transfer member includes a sheet transport belt configured to transfer the toner image to a recording medium.

4. The image forming apparatus according to claim 1, wherein the detecting mechanism is arranged to a specific position not susceptible to heat.

5. The image forming apparatus according to claim 4, wherein the specific position not susceptible to heat is remote from a heat source of the image forming apparatus.

6. The image forming apparatus according to claim 5, wherein the heat source includes at least one of a fixing device and an optical writing device.

7. The image forming apparatus according to claim 1, wherein the moving speed of the moving member is a rotation speed of the detection roller.

8. The image forming apparatus according to claim 1, wherein the moving member and the detection roller form an encoder.

9. The image forming apparatus according to claim 1, wherein the detection roller is disposed at a most remote position from the heat source.

10. The image forming apparatus according to claim 1, wherein the plurality of support rollers comprises:

at least one support roller which switches between different positions to tilt the surface of the transfer member; and at least one support roller which is fixedly positioned, wherein the detection roller is one of the at least one support roller which is fixedly positioned and disposed at a most remote position from the heat source.

11. The image forming apparatus according to claim 1, wherein the plurality of support rollers comprises:

at least one drive roller; and at least one tension roller disposed between the detection roller and the at least one drive roller.

12. The image forming apparatus according to claim 1, wherein the detecting mechanism further comprising an encoder case, and the encoder is sealed in the encoder case.

13. The image forming apparatus according to claim 1, wherein a multiplication of a circumference length of the detection roller by a positive integer is equal to a transfer pitch distance of the at least one image carrying member.

14. The image forming apparatus according to claim 1, wherein the detection roller includes a material having a diameter expansion rate of 0.05% or less against temperature.

15. The image forming apparatus according to claim 1, wherein a linear expansion coefficient of a material of the detection roller is substantially $25\times10^{-6}$ (1/° C.) or less.

16. The image forming apparatus according to claim 1, wherein the detection roller includes aluminum.

17. The image forming apparatus according to claim 1, wherein the detection roller includes iron.

18. The image forming apparatus according to claim 1, wherein the detection roller includes stainless steel.

19. The image forming apparatus according to claim 1, wherein the detection roller includes INVAR (Fe—Ni).

20. An image forming apparatus, comprising:

at least one image carrying member configured to form a toner image on a surface thereof;

a transfer member having a surface facing the at least one image carrying member and configured to transfer the toner image to a recording medium;

a plurality of support rollers supporting the transfer member; and a detecting mechanism configured to detect a speed of the transfer member, comprising:

a detection roller including at least one support roller selected from the plurality of support rollers;

a roller shaft provided to the detection roller;

a moving member configured to rotate with the detection roller and directly fixed to the roller shaft;

a sensor configured to detect a moving speed of the detection roller with the moving member; and a controller configured to control a traveling speed of the transfer member to a target speed based on a detection result of the sensor, wherein the detection roller and the moving member are arranged such that a first radial line extending from a central axis line of the roller shaft to a maximum radius point of the detection roller is positioned at substantially a same radial angle about the central axis line as a second radial line extending from the central axis line of the roller shaft to a minimum radius point of the moving member.

21. The image forming apparatus according to claim 20, wherein the moving member is provided with a mark indicating the minimum radius point of the moving member.

22. An image forming apparatus, comprising:

at least one image carrying member configured to form a toner image on a surface thereof;

a transfer member having a surface facing the at least one image carrying member and configured to transfer the toner image to a recording medium;

a plurality of support rollers supporting the transfer member; and a detecting mechanism configured to detect a speed of the transfer member, comprising:

a detection roller including at least one support roller selected from the plurality of support rollers;

a roller shaft provided to the detection roller;

a moving member configured to rotate with the detection roller and directly fixed to the roller shaft;

a sensor configured to detect a moving speed of the detection roller with the moving member; and a controller configured to control a traveling speed of the transfer member to a target speed based on a detection result of the sensor, wherein the detection roller and the moving member are arranged such that a first radial line extending from a central axis line of the roller shaft to a minimum radius point of the detection roller is positioned at substantially a same radial angle about the central axis line as a second radial line extending from the central axis line of the roller shaft to a maximum radius point of the moving member.

23. The image forming apparatus according to claim 22, wherein the moving member is provided with a mark indicating the maximum radius point of the moving member.

24. An image forming apparatus, comprising:

at least one image carrying member configured to form a toner image on a surface thereof;

a transfer member having a surface facing the at least one image carrying member and configured to transfer the toner image to a recording medium;

a plurality of support rollers supporting the transfer member; and a detecting mechanism configured to detect a speed of the transfer member, comprising:

a detection roller including at least one support roller selected from the plurality of support rollers;

a roller shaft provided to the detection roller;

a moving member configured to rotate with the detection roller and directly fixed to the roller shaft;

a sensor configured to detect a moving speed of the detection roller with the moving member; and a controller configured to control a traveling speed of the transfer member to a target speed based on a detection result of the sensor, wherein a work required to raise temperature by one Celsius degree calculated from a type and amount of a material used to make the detection roller is substantially 30 Joule or more.

25. An image forming apparatus, comprising:

at least one image carrying member configured to form a toner image on a surface thereof;

a transfer member having a surface facing the at least one image carrying member and configured to transfer the toner image to a recording medium;

a plurality of support rollers supporting the transfer member; and a detecting mechanism configured to detect a speed of the transfer member, comprising:

a detection roller including at least one support roller selected from the plurality of support rollers;

a roller shaft provided to the detection roller;

a moving member configured to rotate with the detection roller and directly fixed to the roller shaft;

a sensor configured to detect a moving speed of the detection roller with the moving member; and a controller configured to control a traveling speed of the transfer member to a target speed based on a detection result of the sensor, wherein the detection roller includes carbon fiber.

* * * * *

UNITED STATES PATENT AND TRADEMARK OFFICE

CERTIFICATE OF CORRECTION

PATENT NO. : 7,257,339 B2
APPLICATION NO. : 10/893391
DATED : August 14, 2007
INVENTOR(S) : Yokoyama et al.

It is certified that error appears in the above-identified patent and that said Letters Patent is hereby corrected as shown below:

On the title page, Item (75), the inventor information is incorrect. Item (75) should read:

-- (75) Inventors: Masato Yokoyama, Yokohama (JP); Nobuto Yokokawa, Kawaguchi (JP); Toshiyuki Andoh, Sagamihara (JP); Kazuhiko Kobayashi, Ota-ku (JP); Tadashi Shinohara, Yokohama (JP); Yuuji Matsuda, Inagi (JP); Jun Hosokawa, Ota-ku (JP); Yohhei Miura, Shinagawa (JP); Toshiyuki Takahashi, Kawasaki (JP); Hiromichi Matsuda, Kawasaki (JP) --

Signed and Sealed this

Fourth Day of December, 2007

JON W. DUDAS
*Director of the United States Patent and Trademark Office*